US010734150B2

(12) United States Patent
Otsubo et al.

(10) Patent No.: US 10,734,150 B2
(45) Date of Patent: Aug. 4, 2020

(54) INDUCTOR DEVICE, INDUCTOR ARRAY, AND MULTILAYERED SUBSTRATE, AND METHOD FOR MANUFACTURING INDUCTOR DEVICE

(71) Applicant: Murata Manufacturing Co., Ltd., Kyoto (JP)

(72) Inventors: Yoshihito Otsubo, Kyoto (JP); Norio Sakai, Kyoto (JP); Mitsuyoshi Nishide, Kyoto (JP); Shinichiro Banba, Kyoto (JP); Tatsuyuki Yamada, Kyoto (JP); Tetsuya Kanagawa, Kyoto (JP); Atsuko Omori, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 665 days.

(21) Appl. No.: 15/253,151

(22) Filed: Aug. 31, 2016

(65) Prior Publication Data

US 2016/0372246 A1 Dec. 22, 2016

Related U.S. Application Data

(63) Continuation of application No. PCT/JP2015/054999, filed on Feb. 23, 2015.

(30) Foreign Application Priority Data

Mar. 4, 2014 (JP) ..... 2014-042118
Aug. 8, 2014 (JP) ..... 2014-162423

(51) Int. Cl.
*H01F 5/00* (2006.01)
*H01F 17/04* (2006.01)
(Continued)

(52) U.S. Cl.
CPC ..... *H01F 17/04* (2013.01); *H01F 5/00* (2013.01); *H01F 17/0013* (2013.01);
(Continued)

(58) Field of Classification Search
CPC ..... H01F 5/00; H01F 27/00–27/36
(Continued)

(56) References Cited

U.S. PATENT DOCUMENTS 5,378,297 A 1/1995 Chang et al.
6,031,445 A * 2/2000 Marty ..... H01F 27/2804 257/E21.022
(Continued)

FOREIGN PATENT DOCUMENTS

CN 102460614 A 5/2012
CN 102647854 A 8/2012
(Continued)

OTHER PUBLICATIONS

International Search Report issued in Application No. PCT/JP2015/054999 dated May 12, 2015.
(Continued)

*Primary Examiner* — Tuyen T Nguyen
(74) *Attorney, Agent, or Firm* — Pearne & Gordon LLP

(57) ABSTRACT

An inductor device (1) includes a magnetic body (2) and a conductor buried in the magnetic body (2), and the conductor includes first conductors (3) as metal pins. The magnetic body (2) is formed into a flat plate shape with a first main surface and a second main surface each having a predetermined shape, which oppose each other, and side surfaces connecting the first main surface and the second main surface. The conductor includes the first conductors (3) one end portions of which are exposed to the second main
(Continued)

surface of the magnetic body (2) and a second conductor (4) which is connected to the other end portions of the first conductors (3).

18 Claims, 32 Drawing Sheets

(51) Int. Cl.

| | |
|---|---|
| ***H01F 17/00*** | (2006.01) |
| ***H01F 27/245*** | (2006.01) |
| ***H01F 27/28*** | (2006.01) |
| ***H01F 41/02*** | (2006.01) |
| ***H01F 41/04*** | (2006.01) |

(52) U.S. Cl.
CPC ..... *H01F 27/245* (2013.01); *H01F 27/2804* (2013.01); *H01F 41/0233* (2013.01); *H01F 41/041* (2013.01); *H01F 2017/002* (2013.01); *H01F 2017/0066* (2013.01); *H01F 2027/2809* (2013.01)

(58) Field of Classification Search
USPC ..... 336/65, 83, 192, 196, 200, 232
See application file for complete search history.

(56) References Cited

U.S. PATENT DOCUMENTS

| | | | | |
|---|---|---|---|---|
| 6,106,893 | A | 8/2000 | Uchikoba | |
| 7,081,803 | B2 * | 7/2006 | Takaya | H01F 17/0033 336/200 |
| 8,289,121 | B2 | 10/2012 | Yan et al. | |
| 2003/0156000 | A1 | 8/2003 | Brunner | |
| 2006/0145804 | A1 * | 7/2006 | Matsutani | H01F 27/027 336/200 |
| 2008/0310051 | A1 | 12/2008 | Yan et al. | |
| 2009/0002111 | A1 | 1/2009 | Harrison et al. | |
| 2012/0212919 | A1 | 8/2012 | Mano | |
| 2014/0247269 | A1 * | 9/2014 | Berdy | H01F 1/24 345/501 |

FOREIGN PATENT DOCUMENTS

| | | | | |
|---|---|---|---|---|
| EP | 2106014 | A1 * | 9/2009 | H02M 1/44 |
| GB | 2303494 | A | 2/1997 | |
| JP | S59-44013 | U | 3/1984 | |
| JP | S6034009 | A | 2/1985 | |
| JP | S63-196018 | A | 8/1988 | |
| JP | S63278317 | A | 11/1988 | |
| JP | H01-266705 | A | 10/1989 | |
| JP | H02-226799 | A | 9/1990 | |
| JP | H05-243744 | A | 9/1993 | |
| JP | 2004-127966 | A | 4/2004 | |
| JP | 2004-311473 | A | 11/2004 | |
| JP | 2005-183890 | A | 7/2005 | |
| JP | 2006-013168 | A | 1/2006 | |
| JP | 2007096249 | A | 4/2007 | |
| JP | 2008-108935 | A | 5/2008 | |
| JP | 2009-099752 | A | 5/2009 | |
| JP | 2010-516056 | A | 5/2010 | |
| JP | 2012015151 | A | 1/2012 | |
| JP | 2012-526385 | A | 10/2012 | |
| JP | 2014017314 | A | 1/2014 | |
| JP | 2014-038883 | A | 2/2014 | |
| JP | 2014-038884 | A | 2/2014 | |

OTHER PUBLICATIONS

Written Opinion issued in Application No. PCT/JP2015/054999 dated May 12, 2015.
Chinese Office Action for Application No. 201580011175.5, dated Dec. 5, 2017.
Japanese Reasons for Rejection for Application No. 2016-506429 dated Nov. 14, 2017.
United Kingdom Office action for UK Patent Application No. GB1614957.7 dated Dec. 20, 2019.

* cited by examiner

INDUCTOR DEVICE, INDUCTOR ARRAY, AND MULTILAYERED SUBSTRATE, AND METHOD FOR MANUFACTURING INDUCTOR DEVICE

This is a continuation of International Application No. PCT/JP2015/054999 filed on Feb. 23, 2015 which claims priority from Japanese Patent Application No. 2014-162423 filed on Aug. 8, 2014 and Japanese Patent Application No. 2014-042118 filed Mar. 4, 2014. The contents of these applications are incorporated herein by reference in their entireties.

FIELD OF THE DISCLOSURE

The present disclosure relates to an inductor device, an inductor array, and a multilayered substrate including a conductor buried in a magnetic body, and a method for manufacturing the inductor device.

DESCRIPTION OF THE RELATED ART

An electronic component such as an inductor device or a multilayered substrate includes, for example, a flat plate-like magnetic body and a conductor buried in the magnetic body and functioning as an inductor. This conductor includes a first conductor provided so as to extend perpendicularly to a top surface (flat-plate first main surface) and a bottom surface (flat-plate second main surface) of the magnetic body and a second conductor provided so as to extend in parallel with the top surface and the bottom surface of the magnetic body, for example.

As the multilayered substrate including the conductor functioning as the inductor as described above, for example, a multilayered substrate as disclosed in Japanese Unexamined Patent Application Publication No. 2005-183890 (Patent Document 1) has been proposed.

FIG. 40 is a cross-sectional view of a multilayered substrate 100 as disclosed in Patent Document 1. The multilayered substrate 100 includes a magnetic body 101 having magnetic layers 101*a* to 101*f*, first conductors 102*a* to 102*c*, and second conductors 103*a* to 103*d*.

The first conductor 102*a* connects the second conductor 103*a* and the second conductor 103*b*. The first conductor 102*b* connects the second conductor 103*b* and the second conductor 103*c*. The first conductor 102*c* connects the second conductor 103*c* and the second conductor 103*d*.

That is to say, the first conductors 102*a* to 102*c* and the second conductors 103*b* and 103*c* form one continuous conductor 104 connecting the second conductor 103*a* and the second conductor 103*d*. The conductor 104 functions as an inductor having inductance in the magnetic body 101.

Patent Document 1: Japanese Unexamined Patent Application Publication No. 2005-183890

BRIEF SUMMARY OF THE DISCLOSURE

In the multilayered substrate 100, the first conductors 102*a* to 102*c* are so-called through-hole conductors or via conductors that are provided so as to be perpendicular to the top surface and the bottom surface of the magnetic body 101. These conductors are formed by application of plating films to inner side surfaces of through-holes, filling of the through-holes with conductive pastes, so-called via-fill plating, combination thereof, or the like.

However, it is difficult to uniformly apply the plating films to the inner side surfaces of the through-holes having small diameters, fill overall the through-holes having the small diameters with the conductive pastes, or sufficiently perform the via-fill plating. That is to say, with the above-described method, the first conductors 102*a* to 102*c* cannot be formed with high accuracy and defects are easy to be generated therein.

For this reason, in the multilayered substrate 100, specific resistances of the first conductors 102*a* to 102*c* are increased and variations thereof are increased. It is therefore difficult to make a resistance value of one conductor 104 within a predetermined range. Furthermore, the conductor having such a defected portion is easy to generate heat at the time of energization, resulting in a risk that reliability of the multilayered substrate 100 is deteriorated.

On the other hand, the first conductors 102*a* to 102*c* can be also formed by a method in which through-holes are formed in the magnetic layers 101*a* to 101*f* and partial first conductors are previously formed in the through-holes, and then, the magnetic layers 101*a* to 101*f* are laminated so as to connect the partial first conductors.

Also in this case, when lamination displacement occurs in the magnetic layers 101*a* to 101*f*, variation is generated in a connection manner of the partial first conductors depending on the degree of the lamination displacement. Due to this, the resistance value of one conductor 104 is increased and the variation thereof is increased.

In addition, portions at which the partial first conductors are connected in a displaced manner with steps are easy to generate heat at the time of energization. As a result, reliability of the multilayered substrate 100 is deteriorated.

An object of the present disclosure is to provide an inductor device, an inductor array, and a multilayered substrate which have low specific resistance of a conductor, have small variation thereof, and have high reliability, and a method for manufacturing the inductor device.

The present disclosure tries to improve a conductor included in an inductor device, an inductor array, and a multilayered substrate.

The present disclosure is directed to an inductor device, first.

An inductor device according to an aspect of the present disclosure includes a magnetic body and a conductor buried in the magnetic body, wherein the conductor includes a first conductor as a metal pin.

In the above-described inductor device, at least a part of the conductor is formed by the metal pin. Therefore, defects inside the conductor, such as an unfilled portion with conductive pastes, a plating unformed portion, and a lamination displaced portion, are not generated at the corresponding site.

As a result, specific resistance of the conductor is lowered and variation thereof is reduced. In addition, heat generation at the time of energization is reduced, thereby improving reliability of the inductor device.

In a first preferred embodiment of the inductor device in the aspect of the present disclosure, one end portion of the first conductor is exposed to an outer surface of the magnetic body.

In the above-described inductor device, the one end portion of the first conductor is exposed to the outer surface of the magnetic body. Therefore, the one end portion of the first conductor corresponds to an outer electrode. Accordingly, a process of providing the outer electrode is not required.

As a result, the configuration of the inductor device is simplified and reliability of the inductor device is improved. Furthermore, the inductor device can be manufactured at low cost.

In the above-described first preferred embodiment of the inductor device in the aspect of the present disclosure, it is more preferable that an area of an end surface of the one end portion of the first conductor, which is exposed to the outer surface of the magnetic body, be larger than a cross-sectional area of the first conductor in the magnetic body.

In the above-described inductor device, the area of the end surface of the one end portion of the first conductor, which is exposed to a second main surface of the magnetic body, is larger than the cross-sectional area of the first conductor in the magnetic body. Therefore, when the inductor device is mounted on a circuit substrate of an electronic apparatus, a contact area thereof with a bonding material is increased.

As a result, strength of a bonding portion is improved and reliability of the electronic apparatus including the inductor device is improved.

In a second preferred embodiment of the inductor device in the aspect of the present disclosure, one end portion of the first conductor is provided on an outer surface of the magnetic body and is connected to an outer electrode having an area larger than a cross-sectional area of the first conductor.

In the above-described inductor device, the end portion of the first conductor is connected to the outer electrode having the area larger than the cross-sectional area of the first conductor. Therefore, when the inductor device is mounted on a circuit substrate of an electronic apparatus, a contact area thereof with a bonding material is increased.

As a result, strength of a bonding portion is improved and reliability of the electronic apparatus including the inductor device is improved.

In a third preferred embodiment of the inductor device in the aspect of the present disclosure, the magnetic body is formed into a flat plate shape with a first main surface and a second main surface each having a predetermined shape, which oppose each other, and side surfaces connecting the first main surface and the second main surface. Furthermore, the conductor includes the first conductor and a second conductor which is connected to the other end portion of the first conductor. In addition, the first conductor is provided so as to extend perpendicularly to the first main surface and the second main surface of the magnetic body and the second conductor is provided so as to extend in parallel with the first main surface and the second main surface of the magnetic body.

In the above-described inductor device, the magnetic body is formed into the flat plate shape with a top surface as the first main surface, a bottom surface as the second main surface, and the side surfaces connecting the top surface and the bottom surface. Furthermore, the first conductor is an alternative of a through-hole conductor or a via conductor provided so as to extend perpendicularly to the top surface and the bottom surface of the magnetic body in the existing inductor device.

Accordingly, in the above-described inductor device, the first conductor is not required to be formed by application of a plating film to the inner side surface of a through-hole, filling of the through-hole with conductive pastes, or via-fill plating unlike the existing inductor device.

Therefore, the first conductor can be formed with high accuracy. Furthermore, the second conductor can be formed efficiently by printing of conductive pastes, for example. In addition, defects inside the conductor, such as an unfilled portion with conductive pastes, a plating unformed portion, and a lamination displaced portion, are not generated in the first conductor.

As a result, defects inside the conductor are decreased, so that specific resistance of the conductor is lowered and variation thereof is reduced. In addition, heat generation at the time of energization is reduced, thereby improving reliability of the inductor device.

In the above-described third preferred embodiment of the inductor device in the aspect of the present disclosure, it is more preferable that the second conductor include an underlayer and a plated layer formed on a surface of the underlayer. Furthermore, the first conductor is directly connected to both of the underlayer and the plated layer of the second conductor.

In the above-described inductor device, the second conductor includes the plated layer having conductivity higher than that of a conductor formed with conductive pastes. Furthermore, the plated layer and the first conductor are directly connected. Therefore, a resistance value caused by a connecting portion between the first conductor and the second conductor can be decreased.

As a result, specific resistance of the conductor is lowered and variation thereof is reduced. In addition, heat generation at the time of energization is reduced, thereby improving reliability of the inductor device.

In the above-described third preferred embodiment of the inductor device in the aspect of the present disclosure, it is more preferable that the second conductor be a metal pin.

In the above-described inductor device, the second conductor is the metal pin having conductivity higher than that of a conductor formed with conductive pastes. Therefore, specific resistance of the second conductor can be lowered.

As a result, specific resistance of the conductor is lowered and variation thereof is reduced. In addition, heat generation at the time of energization is reduced, thereby improving reliability of the inductor device.

In the above-described third preferred embodiment of the inductor device in the aspect of the present disclosure, it is more preferable that the conductor be one bent metal pin in which the first conductor and the second conductor are integrated.

In the above-described inductor device, one metal pin is bent so as to form the first conductor and the second conductor. Accordingly, there is no connecting portion between the first conductor and the second conductor, so that no resistance value caused by the connecting portion is generated.

As a result, specific resistance of the conductor is lowered and variation thereof is reduced. In addition, heat generation at the time of energization is reduced, thereby improving reliability of the inductor device.

In a fourth preferred embodiment of the inductor device in the aspect of the present disclosure, the conductor includes the plurality of first conductors.

In the above-described inductor device, the conductor includes the plurality of first conductors with no defect inside the conductors, such as an unfilled portion with conductive pastes, a plating unformed portion, and a lamination displaced portion, thereby further decreasing the defects inside the conductor.

As a result, specific resistance of the conductor is further lowered and variation thereof is further reduced. In addition, heat generation at the time of energization is further reduced, thereby improving reliability of the inductor device.

Furthermore, the present disclosure is also directed to an inductor array.

An inductor array according to another aspect of the present disclosure includes a magnetic body and a plurality of conductors buried in the magnetic body with predetermined array, wherein each conductor includes a first conductor as a metal pin.

In the above-described inductor array, at least a part of each conductor is formed by the metal pin. Therefore, defects inside the conductor, such as an unfilled portion with conductive pastes, a plating unformed portion, and a lamination displaced portion, are not generated at the corresponding site.

As a result, specific resistance of the conductor is lowered and variation thereof is reduced. In addition, heat generation at the time of energization is reduced, thereby improving reliability of the inductor array.

In a preferred embodiment of the inductor array in the aspect of the present disclosure, the magnetic body is formed into a flat plate shape with a first main surface and a second main surface each having a predetermined shape, which oppose each other, and side surfaces connecting the first main surface and the second main surface. Furthermore, the conductor includes the first conductor and a second conductor which is connected to an end portion of the first conductor. In addition, the first conductor is provided so as to extend perpendicularly to the first main surface and the second main surface of the magnetic body and the second conductor is provided so as to extend in parallel with the first main surface and the second main surface of the magnetic body.

In the above-described inductor array, the magnetic body is formed into the flat plate shape with a top surface as the first main surface, a bottom surface as the second main surface, and the side surfaces connecting the top surface and the bottom surface. Furthermore, the first conductor is an alternative of a through-hole conductor or a via conductor provided so as to extend perpendicularly to the top surface and the bottom surface of the magnetic body in the existing inductor array.

Accordingly, in the above-described inductor array, the first conductor is not required to be formed by application of a plating film to the inner side surface of a through-hole, filling of the through-hole with conductive pastes, or via-fill plating unlike the existing inductor array.

Therefore, the first conductor can be formed with high accuracy. Furthermore, the second conductor can be formed efficiently by printing of conductive pastes, for example. In addition, defects inside the conductor, such as an unfilled portion with conductive pastes, a plating unformed portion, and a lamination displaced portion, are not generated in the first conductor.

As a result, defects inside the conductor are decreased, so that specific resistance of the conductor is lowered and variation thereof is reduced. In addition, heat generation at the time of energization is reduced, thereby improving reliability of the inductor array.

Furthermore, the present disclosure is also directed to a multilayered substrate.

A multilayered substrate according to still another aspect of the present disclosure includes a magnetic layer and a conductor buried in the magnetic layer, wherein the conductor includes a first conductor as a metal pin.

In the above-described multilayered substrate, at least a part of the conductor is the metal pin. Therefore, defects inside the conductor, such as an unfilled portion with conductive pastes, a plating unformed portion, and a lamination displaced portion, are not generated at the corresponding site.

As a result, specific resistance of the conductor is lowered and variation thereof is reduced. In addition, heat generation at the time of energization is reduced, thereby improving reliability of the multilayered substrate.

In a preferred embodiment of the multilayered substrate in the aspect of the present disclosure, the magnetic layer is formed into a flat plate shape with a first main surface and a second main surface each having a predetermined shape, which oppose each other, and side surfaces connecting the first main surface and the second main surface. Furthermore, the conductor includes the first conductor and a second conductor which is connected to an end portion of the first conductor. In addition, the first conductor is provided so as to extend perpendicularly to the first main surface and the second main surface of the magnetic layer and the second conductor is provided so as to extend in parallel with the first main surface and the second main surface of the magnetic layer.

In the above-described multilayered substrate, the magnetic layer is formed into the flat plate shape with a top surface as the first main surface, a bottom surface as the second main surface, and the side surfaces connecting the top surface and the bottom surface. Furthermore, the first conductor is an alternative of a through-hole conductor or a via conductor provided so as to be perpendicular to the top surface and the bottom surface of the magnetic layer in the existing multilayered substrate.

Accordingly, in the above-described multilayered substrate, the first conductor is not required to be formed by application of a plating film to the inner side surface of a through-hole, filling of the through-hole with conductive pastes, or via-fill plating unlike the existing multilayered substrate.

Therefore, the first conductor can be formed with high accuracy. Furthermore, the second conductor can be formed efficiently by printing of conductive pastes, for example. In addition, defects inside the conductor, such as an unfilled portion with conductive pastes, a plating unformed portion, and a lamination displaced portion, are not generated in the first conductor.

As a result, defects inside the conductor are decreased, so that specific resistance of the conductor is lowered and variation thereof is reduced. In addition, heat generation at the time of energization is reduced, thereby improving reliability of the multilayered substrate.

Furthermore, the present disclosure is also directed to a method for manufacturing an inductor device.

A first embodiment of a method for manufacturing the inductor device according to still another aspect of the present disclosure is a method for manufacturing an inductor device including a magnetic body and a conductor that has a first conductor and a second conductor and is buried in the magnetic body.

The first embodiment of the method for manufacturing the inductor device in the aspect of the present disclosure includes the following first to eighth processes.

In the first process, the other end portion of the first conductor as a metal pin is temporarily fixed onto a first base such that the first conductor is temporarily supported on the first base.

In the second process, an uncured product of a magnetic layer as a part of the magnetic body is prepared on a second base.

In the third process, the magnetic layer as the part of the magnetic body is formed by inserting one end portion of the first conductor into the uncured product of the magnetic layer as the part of the magnetic body, and then, curing the uncured product.

In the fourth process, the first base is removed from the other end portion of the first conductor.

In the fifth process, another magnetic layer as another part of the magnetic body is formed on the second base such that the first conductor is buried in the another magnetic layer in a state where the other end portion of the first conductor is exposed.

In the sixth process, the second conductor which is connected to the other end portion of the first conductor and has a predetermined pattern is formed on the another magnetic layer as the another part of the magnetic body.

In the seventh process, the magnetic body is formed by forming still another magnetic layer as a remaining part of the magnetic body on the another magnetic layer as the another part of the magnetic body such that the second conductor is buried in the still another magnetic layer.

In the eighth process, the second base is removed from the magnetic body and the one end portion of the first conductor is exposed to an outer surface of the magnetic body.

In the above-described method for manufacturing the inductor device, the first conductor is fixed by the magnetic layer as the part of the magnetic body in the third process. With this, when the another magnetic layer as the another part of the magnetic body is formed in the fifth process, the first conductor does not tilt or fall down due to fluid pressure of magnetic material-containing resin in a form of liquid, for example.

As a result, the inductor device can be manufactured with high yield.

A second embodiment of the method for manufacturing the inductor device in the aspect of the present disclosure is a method for manufacturing an inductor device including a magnetic body and a conductor that has a first conductor and a second conductor with an underlayer and a plated layer and is buried in the magnetic body.

The second embodiment of the method for manufacturing the inductor device in the aspect of the present disclosure includes the following first to sixth processes.

In the first process, one end portion of the first conductor as a metal pin is temporarily fixed onto a base such that the first conductor is temporarily supported on the base.

In the second process, a magnetic layer as a part of the magnetic body is formed on the base such that the first conductor is buried in the magnetic layer in a state where the other end portion of the first conductor is exposed.

In the third process, the underlayer which is connected to the other end portion of the first conductor and has a predetermined pattern is formed on the magnetic layer as the part of the magnetic body.

In the fourth process, the base is removed from the magnetic layer as the part of the magnetic body and the one end portion of the first conductor is exposed to an outer surface of the magnetic layer as the part of the magnetic body.

In the fifth process, the second conductor having a predetermined pattern is formed by growing the plated layer onto the exposed surface of the underlayer while the underlayer serves as a base member.

In the sixth process, the magnetic body is formed by forming a magnetic layer as a remaining part of the magnetic body on the magnetic layer as the part of the magnetic body such that the second conductor is buried in the magnetic layer as the remaining part of the magnetic body.

In the above-described method for manufacturing the inductor device, the first conductor is buried in the magnetic layer as the part of the magnetic body, and then, the second conductor with the plated layer is formed. Then, the magnetic layer as the remaining part of the magnetic body is formed such that the second conductor is buried therein. That is to say, the conductor is buried in the magnetic body with two processes before and after the formation of the second conductor.

As a result, manufacturing the inductor device can be executed with simpler processes than those in the first embodiment even when the process of forming the plated layer is added.

A third embodiment of the method for manufacturing the inductor device in the aspect of the present disclosure is a method for manufacturing an inductor device including a magnetic body and a conductor that has a first conductor and a second conductor with an underlayer and a plated layer and is buried in the magnetic body in the same manner as the second embodiment.

The third embodiment of the method for manufacturing the inductor device in the aspect of the present disclosure includes the following first to eighth processes.

In the first process, the other end portion of the first conductor as a metal pin is temporarily fixed onto a first base such that the first conductor is temporarily supported on the first base.

In the second process, an uncured product of a magnetic layer as a part of the magnetic body is prepared on a second base.

In the third process, the magnetic layer as the part of the magnetic body is formed by inserting one end portion of the first conductor into the uncured product of the magnetic layer as the part of the magnetic body until it abuts against the second base, and then, curing the uncured product.

In the fourth process, the first base is removed from the other end portion of the first conductor.

In the fifth process, the underlayer which is connected to the other end portion of the first conductor and has a predetermined pattern is formed on the magnetic layer as the part of the magnetic body.

In the sixth process, the second base is removed from the magnetic body and the one end portion of the first conductor is exposed to an outer surface of the magnetic body.

In the seventh process, the second conductor having a predetermined pattern is formed by growing the plated layer onto the exposed surface of the underlayer while the underlayer serves as a base member.

In the eighth process, the magnetic body is formed by forming a magnetic layer as a remaining part of the magnetic body on the magnetic layer as the part of the magnetic body such that the second conductor is buried in the magnetic layer as the remaining part of the magnetic body.

In the above-described method for manufacturing the inductor device, the first conductor is buried in the magnetic layer as the part of the magnetic body, and then, the second conductor with the plated layer is formed. Then, the magnetic layer as the remaining part of the magnetic body is formed such that the second conductor is buried therein. That is to say, the conductor is buried in the magnetic body with two processes before and after the formation of the second conductor.

As a result, manufacturing the inductor device can be executed with simpler processes than those in the first embodiment even when the process of forming the plated layer is added.

In an inductor device, an inductor array, and a multilayered substrate according to the present disclosure, at least a part of a conductor is a metal pin. Therefore, defects inside the conductor, such as an unfilled portion with conductive pastes, a plating unformed portion, and a lamination displaced portion, are not generated at the corresponding site.

As a result, in the inductor device, the inductor array, and the multilayered substrate according to the present disclosure, specific resistance of the conductor is lowered and variation thereof is reduced. In addition, heat generation at the time of energization is reduced, thereby improving reliability of the inductor device.

BRIEF DESCRIPTION OF THE SEVERAL VIEWS OF THE DRAWINGS

FIG. 5C is a partial enlarged view illustrating the vicinity of one end portion of the first conductor 3 after a magnetic layer 2*a* is thermally cured.

DETAILED DESCRIPTION OF THE DISCLOSURE

Hereinafter, characteristics of the present disclosure will be described more in detail using embodiments of the present disclosure.

First Embodiment of Inductor Device

The configuration, a manufacturing method, and variations of an inductor device 1 according to a first embodiment of the present disclosure will be described with reference to FIG. 1 to FIG. 14.

<Configuration of Inductor Device>

The configuration of the inductor device 1 according to the first embodiment of the present disclosure will be described with reference to FIG. 1 and FIGS. 2A, 2B and 2C.

Figure 1:
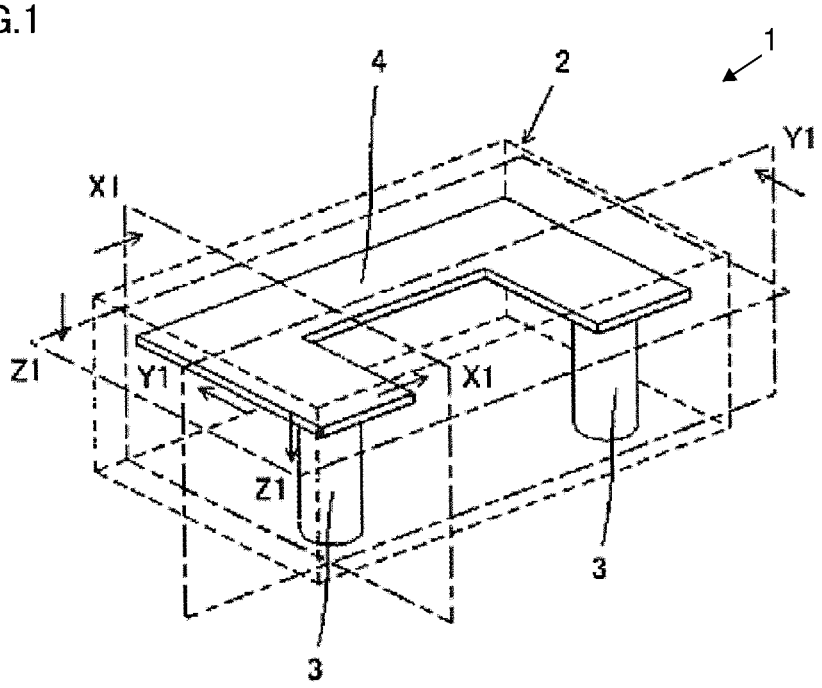
FIG. 1 is a see-through perspective view illustrating first conductors 3 and a second conductor 4 while seeing through a magnetic body 2 in an inductor device 1 according to a first embodiment of the present disclosure.
Figure 2A:
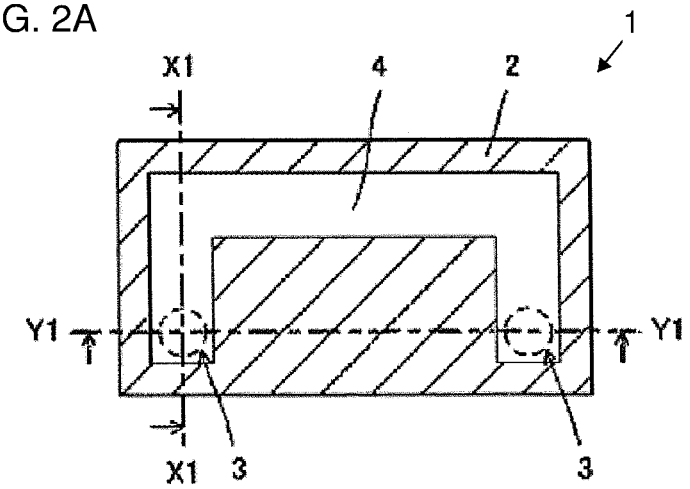
FIGS. 2A, 2B and 2C include cross-sectional views illustrating the inductor device 1 illustrated in FIG. 1 when viewed in an arrow direction.
Figure 2B:
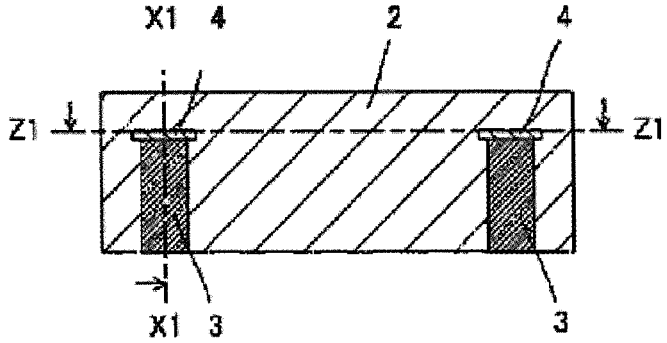
Figure 2C:
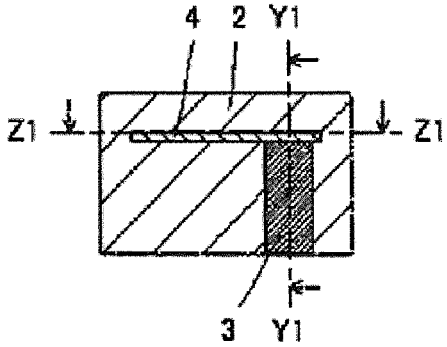

FIG. 1 is a see-through perspective view illustrating first conductors 3 and a second conductor 4 while seeing through a magnetic body 2 in the inductor device 1 according to the first embodiment of the present disclosure. FIG. 2A is a cross-sectional view of a plane containing a line Z1-Z1 in FIG. 1 when viewed in the arrow direction. FIG. 2B is a cross-sectional view of a plane containing a line Y1-Y1 in FIG. 1 when viewed in the arrow direction. FIG. 2C is a cross-sectional view of a plane containing a line X1-X1 in FIG. 1 when viewed in the arrow direction.

The inductor device 1 in the first embodiment is configured by including the magnetic body 2 and a conductor that is buried in the magnetic body 2 and has the two first conductors 3 as metal pins and the second conductor 4 as a cured product of conductive pastes.

The magnetic body 2 is formed into a rectangular parallelepiped shape with a top surface as a first main surface and a bottom surface as a second main surface each having a rectangular shape, which oppose each other, and four side surfaces connecting the top surface and the bottom surface in the first embodiment.

It should be noted that the shape of the magnetic body 2 is not limited to the above-described rectangular parallelepiped shape. It is sufficient that the shape is a flat plate shape with a top surface and a bottom surface each having a predetermined shape, which oppose each other, and the arbitrary number of side surfaces each having an arbitrary shape, which connect the top surface and the bottom surface. The flat plate is a concept including the case in which connecting portions (ridge lines and corners) between the top surface and the bottom surface and the side surfaces are cut off by barrel polishing or the like in a manufacturing process, for example.

The first conductors 3 are provided so as to be perpendicular to the top surface and the bottom surface of the magnetic body 2 and the second conductor 4 is provided so as to be in parallel with the top surface and the bottom surface of the magnetic body 2.

In the inductor device 1 in the first embodiment, the magnetic body 2 is formed using magnetic material-containing resin obtained by mixing insulating thermosetting resin and magnetic filler such as ferrite powder.

It should be noted that the magnetic material-containing resin is not limited to the thermosetting resin and photocurable resins or the like may be used therefor, for example. The magnetic body 2 is not limited to be formed by the magnetic material-containing resin depending on materials of the first conductors 3 and the second conductor 4 and may be formed as a sintered body made of magnetic powder such as the ferrite powder.

The metal pins as the first conductors 3, which are made of Cu, Cu alloy such as Cu—Ni alloy, Fe, or the like as a material, are previously formed into predetermined shapes, and have enough strength to withstand load acting in a third process (first conductor transfer process), which will be described later, are used.

That is to say, the metal pins in the present disclosure are provided as metal wires which previously have the predetermined shapes and strength when the inductor device 1 is manufactured.

In other words, wire-like metal members that are generated in the manufacturing process of the inductor device 1, such as a cured product of conductive pastes, a plated grown product grown to have a predetermined shape, and a sintered body made of metal powder, are excluded from the metal pins in the present disclosure.

The metal pins as the first conductors 3 are alternatives of through-hole conductors or via conductors provided so as to be perpendicular to the top surface and the bottom surface of the magnetic body in the existing inductor device. Furthermore, the end surfaces of one end portions of the first conductors 3 are exposed to the bottom surface of the magnetic body 2 so as to function as outer electrodes of the inductor device 1.

In the above-described inductor device 1, the first conductors 3 are not required to be formed by application of plating films to inner side surfaces of through-holes, filling of the through-holes with conductive pastes, or via-fill plating unlike the existing inductor device.

Therefore, the first conductors 3 can be formed with high accuracy in the inductor device 1 in the first embodiment. Furthermore, the second conductor 4 can be formed efficiently by printing of the conductive pastes, for example. Moreover, defects inside the conductor are decreased, so that specific resistance of the conductor is lowered and variation thereof is reduced. In addition, heat generation at the time of energization is reduced, thereby improving reliability of the inductor device 1.

Furthermore, a process of providing an outer electrode is not needed. Therefore, the configuration of the inductor device 1 is simplified, thereby improving the reliability of the inductor device 1 also in this point. The inductor device 1 can be manufactured at low cost.

Moreover, in the inductor device 1 in the first embodiment, a minute inductance value necessary in an electronic circuit to which a high-frequency signal is input can be obtained easily.

The second conductor 4 is formed into a predetermined pattern with the conductive pastes using Cu or the like as metal filler, for example. Note that when the magnetic body 2 is formed as the sintered body made of the magnetic powder, the second conductor 4 can be formed as a sintered body made of Cu powder, for example. Alternatively, the metal pin may be used for the second conductor 4 like the first conductors 3.

The second conductor 4 is connected to each of the other end portions of the two first conductors 3 in the magnetic body 2. When the second conductor 4 is formed using the conductive pastes, for example, the conductive pastes are applied to the other end portions of the first conductors 3 so as to connect the first conductors 3 and the second conductor 4, which will be described later. Alternatively, when the second conductor 4 is formed using the metal pin, the above-described conductive pastes are applied to the other end portions of the first conductors 3 so as to connect the first conductors 3 and the second conductor 4.

The conductor formed by the connected first conductors 3 and second conductor 4 functions as an inductor having inductance in the magnetic body 2.

The conductor is buried in the magnetic body 2 as described above. In the present disclosure, what the conductor is buried in the magnetic body 2 is not limited to that the entire conductor is located at the inner side of the magnetic body 2. That is to say, as will be described later, what the conductor is buried in the magnetic body 2 is a concept including the case in which larger parts of the first conductors 3 and the second conductor 4 are located at the inner side of the magnetic body 2 but a part thereof is located at the outer side of the magnetic body 2, such as the case in which one end portions of the first conductors 3 project from the bottom surface of the magnetic body 2.

<Method for Manufacturing Inductor Device>

An example of a method for manufacturing the inductor device 1 according to the first embodiment of the present disclosure will be described with reference to FIG. 3A to FIG. 10B. FIG. 3A to FIG. 10B are views schematically illustrating a first process to an eighth process that are sequentially performed in the example of the method for manufacturing the inductor device 1. In each of FIG. 3A to FIG. 10B, A corresponds to a top view and B corresponds to a cross-sectional view of a plane containing a line Y1-Y1 in A when viewed in the arrow direction.

<First Process>

Figure 3A:
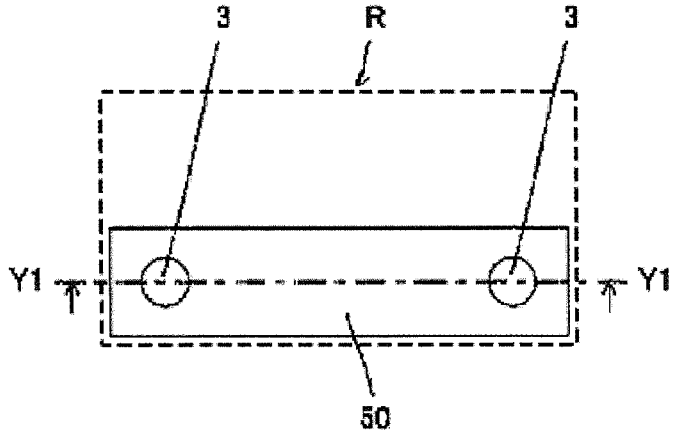
FIGS. 3A and 3B include views for explaining an example of a method for manufacturing the inductor device 1 illustrated in FIG. 1 and FIGS. 2A, 2B and 2C and schematically illustrating a first process (first conductor preparation process).
Figure 3B:
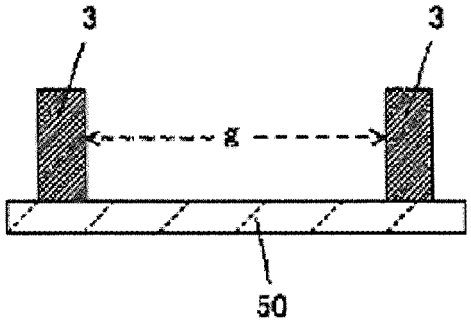

FIGS. 3A, and 3B are views schematically illustrating a first process (first conductor preparation process) in the method for manufacturing the inductor device 1. With the first process, the first conductors 3 are made into a state of being temporarily supported on a first base 50.

In the first process, the first conductors 3 as the metal pins made of Cu, Cu alloy such as Cu—Ni alloy, Fe, or the like as the material and the plate-like first base 50 on which the other end portions of the first conductors 3 are supported on one main surface are prepared. A region R as indicated by a dashed line in FIG. 3A virtually expresses a position of an uncured magnetic layer 2*a* that is prepared in the second process (first conductor-transferring magnetic layer preparation process), which will be described later.

Then, the two first conductors 3 are temporarily fixed onto the first base 50 so as to form a gap g therebetween with which the inductor device 1 can obtain desired inductance. The first base 50 is a member temporarily supporting the first conductors 3 in order to facilitate transfer of the first conductors 3 to the magnetic layer 2*a* and is removed in the fourth process (first base removal process), which will be described later.

Therefore, a temporal adhesive member such as an adhesive sheet, for example, is provided on the surface of the first base 50 so as to enable the first conductors 3 to be temporarily fixed thereon.

<Second Process>

Figure 4A:
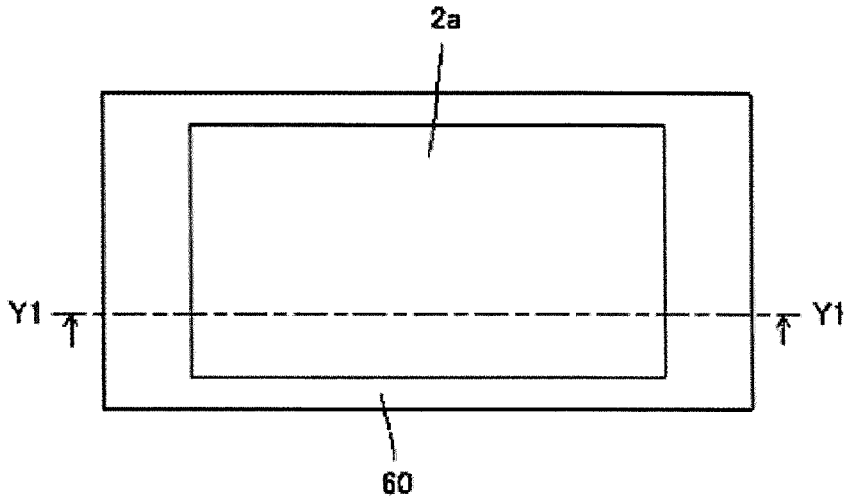
FIGS. 4A and 4B include views schematically illustrating a second process (first conductor-transferring magnetic layer preparation process) that is executed after the first process illustrated in FIGS. 3A and 3B.
Figure 4B:
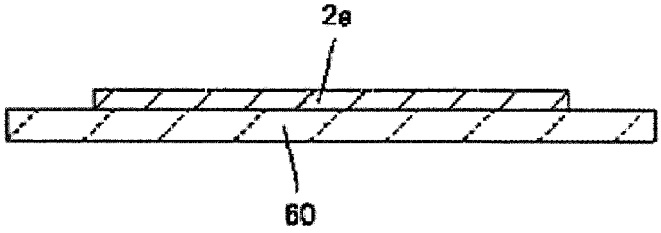

Each of FIGS. 4A and 4B is a view schematically illustrating the second process (first conductor-transferring magnetic layer preparation process) in the method for manufacturing the inductor device 1. With the second process, the uncured magnetic layer 2*a* is made into a state of being supported on a second base 60.

In the second process, the plate-like second base 60 supporting the uncured magnetic layer 2*a* on one main surface thereof is prepared. The magnetic layer 2*a* is formed using the magnetic material-containing resin obtained by mixing the insulating thermosetting resin and the magnetic filler such as the ferrite powder as described above.

As the second base 60, for example, a base in which a release layer is formed on a resin sheet made of polyethylene terephthalate, polyethylene naphthalate, polyimide, or the like, or a base in which a resin sheet itself made of fluororesin or the like has a releasing function can be used.

The second base 60 is coated with the magnetic material-containing resin in a form of liquid in a thickness of approximately 50 to 100 μm, for example, so that the uncured magnetic layer 2*a* is prepared.

It should be noted that the uncured magnetic layer 2*a* may be prepared by placing a prepreg made of the magnetic material-containing resin, which is separately produced, on the second base 60.

<Third Process>

Figure 5A:
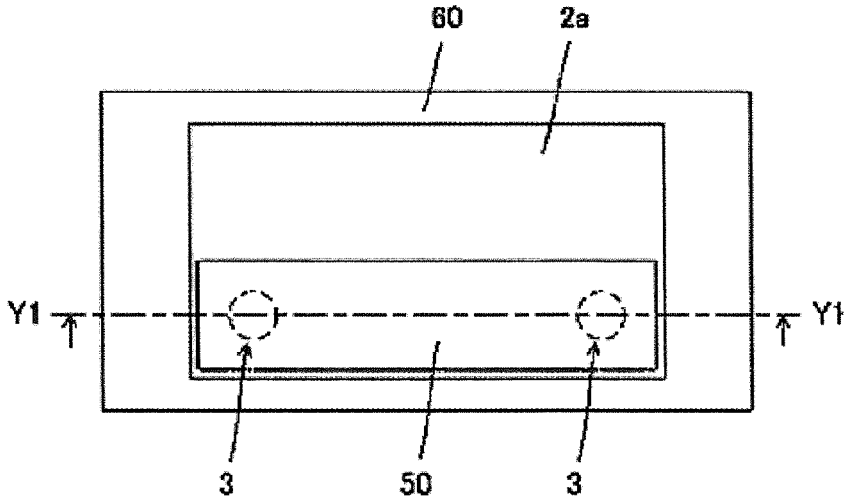
FIGS. 5A, 5B and 5C include views schematically illustrating a third process (first conductor transfer process) that is executed after the second process illustrated in FIGS. 4A and 4B.
Figure 5B:
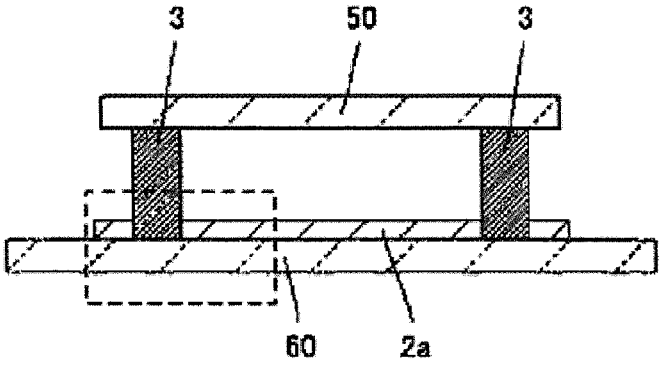
Figure 5C:
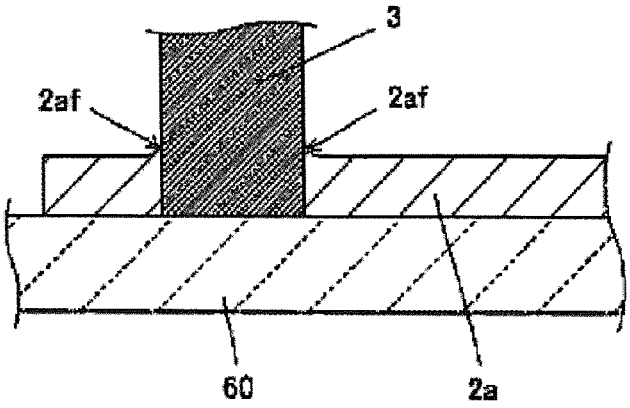

Each of FIGS. 5A, 5B and 5C is a view schematically illustrating the third process (first conductor transfer process) in the method for manufacturing the inductor device 1. With the third process, the first conductors 3 are made into a state in which the other end portions thereof are temporarily fixed onto the first base 50 and one end portions thereof are supported by the cured magnetic layer 2*a*.

In the third process, the first conductors 3 are inserted into the uncured magnetic layer 2*a* until the one end portions of the two first conductors 3 abut against the second base 60. In this state, the magnetic layer 2*a* is thermally cured. With this process, the one end portions of the first conductors 3 are made into a state of being supported by the cured magnetic layer 2*a*. In this specification, the above-described operation is referred to as "first conductor transfer".

By fixing the first conductors 3 by the magnetic layer 2*a*, when a magnetic layer 2*b* is formed in the fifth process (first conductor burying process), which will be described later, the first conductors 3 do not tilt or fall down due to fluid pressure of the magnetic material-containing resin in the form of liquid, for example.

When the uncured magnetic layer 2*a* is thermally cured, it is preferable that the magnetic material-containing resin of the magnetic layer 2*a* be made to wet up on the circumferential surfaces of the one end portions of the first conductor 3. In this case, as illustrated in FIG. 5C as a partial enlarged view of a dashed-line portion in FIG. 5B, fillet-like supporting portions 2*af* in which a part of the cured magnetic layer 2*a* climbs the circumferential surfaces of the one end portions of the first conductors 3 are formed. With this, supporting strength of the first conductors 3 by the cured magnetic layer 2*a* can be improved.

The shape of the fillet-like supporting portions 2*af* can be adjusted by changing the type and the amount of the magnetic material-containing resin forming the magnetic body 2 or performing surface processing on the metal pins as the first conductors 3 to adjust wettability.

<Fourth Process>

Figure 6A:
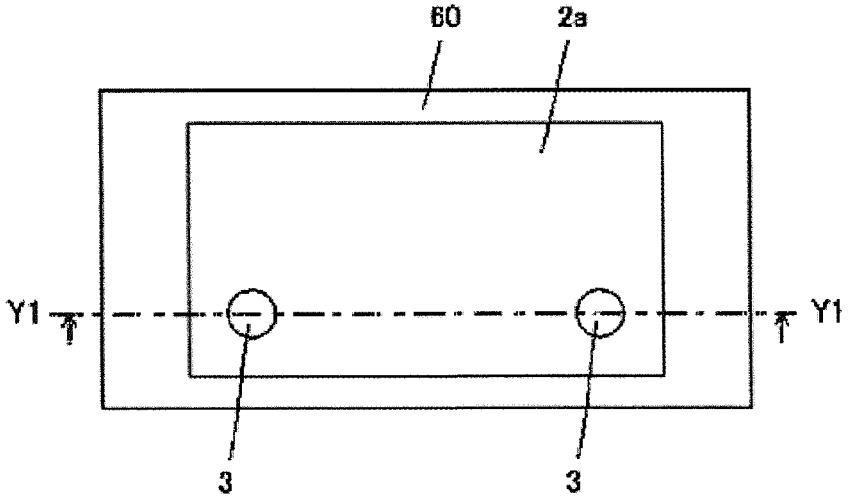
FIGS. 6A and 6B include views schematically illustrating a fourth process (first base removal process) that is executed after the third process illustrated in FIGS. 5A, 5B and 5C.
Figure 6B:
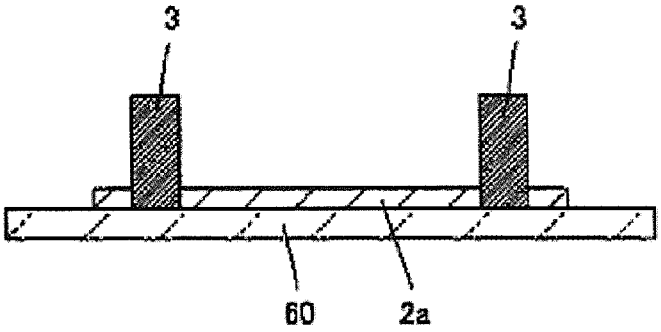

Each of FIGS. 6A and 6B is a view schematically illustrating the fourth process (first base removal process) in the method for manufacturing the inductor device 1. With the fourth process, a state in which the first base 50 that has temporarily fixed the first conductors 3 has been removed is established.

In the fourth process, after the one end portions of the first conductors 3 are reliably supported by the sufficiently cured magnetic layer 2*a*, the first base 50 that has finished its role is removed from the other end portions of the first conductors 3.

<Fifth Process>

Figure 7A:
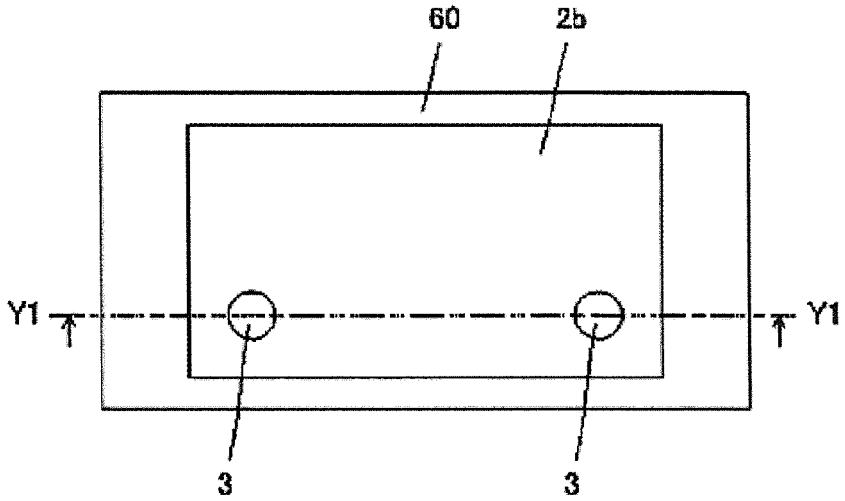
FIGS. 7A and 7B include views schematically illustrating a fifth process (first conductor burying process) that is executed after the fourth process illustrated in FIGS. 6A and 6B.
Figure 7B:
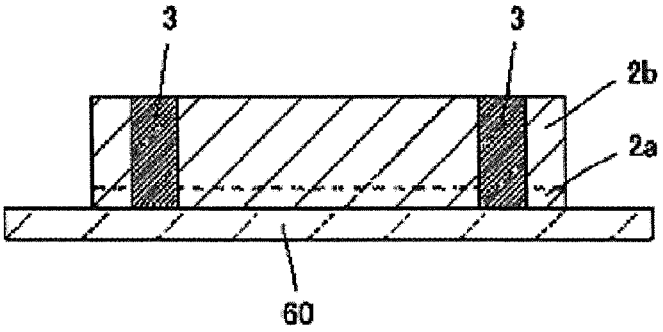

Each of FIGS. 7A and 7B is a view schematically illustrating the fifth process (first conductor burying process) in the method for manufacturing the inductor device 1. With the fifth process, the first conductors 3 are made into a state of being buried in the magnetic layers 2*a* and 2*b*.

In the fifth process, the magnetic layer 2*b* is formed on the cured magnetic layer 2*a* using the same magnetic material-containing resin as the magnetic layer 2*a* by the same formation method. With this process, the first conductors 3 are made into the state of being buried in the magnetic layers 2*a* and 2*b*. It should be noted that the other end portions of the first conductors 3 are exposed to the surface of the magnetic layer 2*b*.

If the magnetic layer 2*b* covers the other end portions of the first conductors 3 in the fifth process, the surface of the magnetic layer 2*b* is polished with a polishing agent softer than the metal pins as the first conductors 3 and harder than the magnetic layer 2*b*, for example. This enables the other end portions of the first conductors 3 to be exposed to the surface of the magnetic layer 2*b* reliably.

The formation of the magnetic layers 2*a* and 2*b* may be formed in such a manner that the magnetic layer 2*a* is formed using the magnetic material-containing resin in the form of liquid and the magnetic layer 2*b* is formed using the prepreg made of the magnetic material-containing resin. Alternatively, the magnetic layer 2*a* and the magnetic layer 2*b* may be formed using magnetic material-containing resins of different types. The magnetic material-containing resins of different types indicate those in which contents of magnetic fillers are the same but types thereof are different, those in which the types of the magnetic fillers are the same but the contents thereof are different, those in which both of the types and the contents of the magnetic fillers are different, those in which types of insulating reins are different, or the like.

<Sixth Process>

Figure 8A:
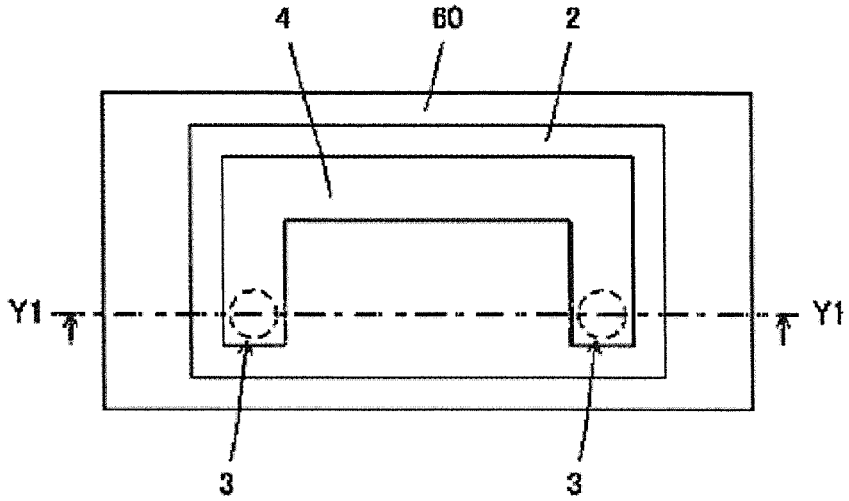
FIGS. 8A and 8B include views schematically illustrating a sixth process (second conductor formation process) that is executed after the fifth process illustrated in FIGS. 7A and 7B.
Figure 8B:
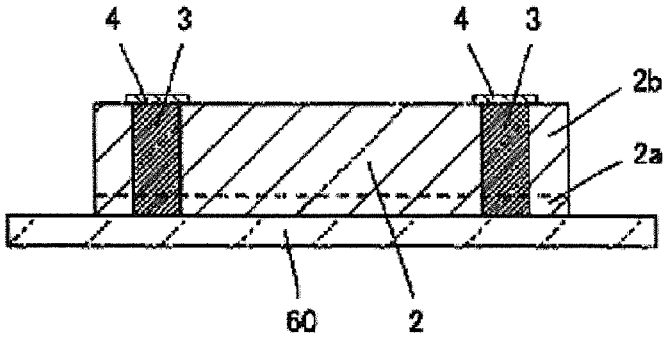

Each of FIGS. 8A and 8B is a view schematically illustrating the sixth process (second conductor formation process) in the method for manufacturing the inductor device 1. With the sixth process, the second conductor 4 having the predetermined pattern is made into a state of being connected to the first conductors 3.

In the sixth process, the second conductor 4 which is connected to the other end portions of the first conductors 3 and has the predetermined pattern is formed on the cured magnetic layer 2*b*.

As described above, the second conductor 4 is formed into the predetermined pattern with the conductive pastes using Cu or the like as the metal filler, for example.

<Seventh Process>

Figure 9A:
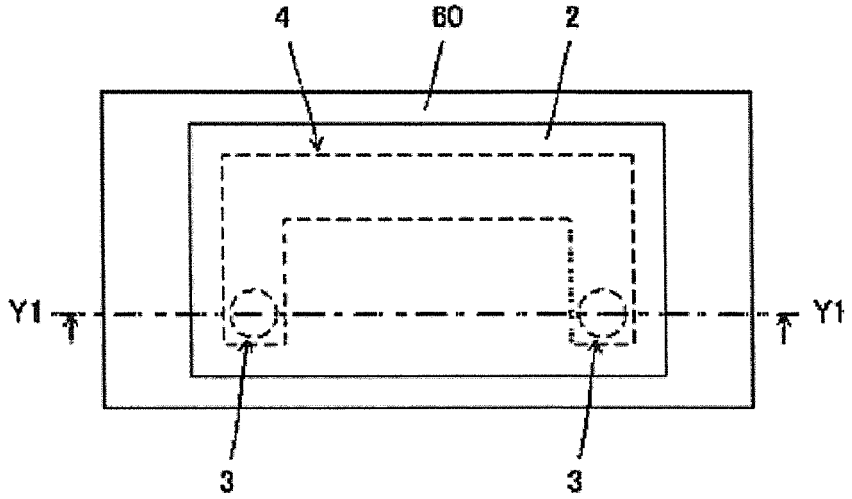
FIGS. 9A and 9B include views schematically illustrating a seventh process (second conductor burying process) that is executed after the sixth process illustrated in FIGS. 8A and 8B.
Figure 9B:
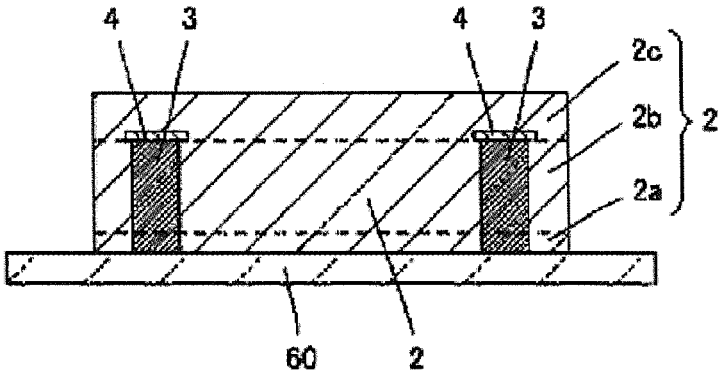

Each of FIGS. 9A and 9B is a view schematically illustrating the seventh process (second conductor burying process) in the method for manufacturing the inductor device 1. With the seventh process, the first conductors 3 and the second conductor 4 are made into a state of being buried in the magnetic body 2 including the magnetic layers 2*a* and 2*b* and a magnetic layer 2*c*.

In the seventh process, the magnetic layer 2*c* is formed on the cured magnetic layer 2*b* using the same magnetic material-containing resin as the magnetic layers 2*a* and 2*b* by the same formation method. With this process, the first conductors 3 and the second conductor 4 are made into the state of being buried in the magnetic body 2 in which the magnetic layers 2*a*, 2*b*, and 2*c* are integrated.

As for the formation of the magnetic layer 2*c*, the magnetic layer 2*c* may be formed using the prepreg of the magnetic material-containing resin in the same manner as the above-described fifth process (first conductor burying process). Alternatively, the magnetic layer 2*a* and the magnetic layer 2*b* may be formed using magnetic material-containing resins of different types.

<Eighth Process>

Figure 10A:
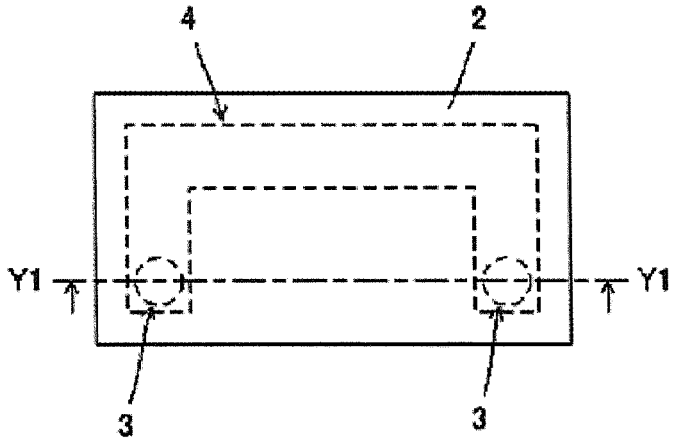
FIGS. 10A and 10B include views schematically illustrating an eighth process (second base removal process) that is executed after the seventh process illustrated in FIGS. 9A and 9B.
Figure 10B:
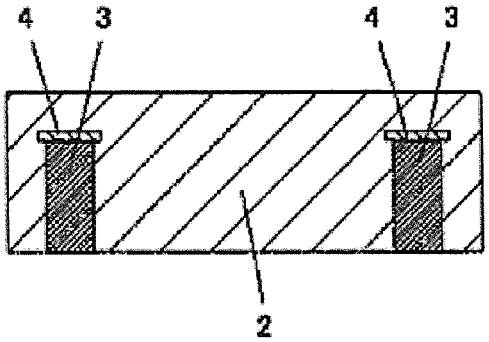

Each of FIGS. 10A and 10B is a view schematically illustrating the eighth process (second base removal process) in the method for manufacturing the inductor device 1. With the eighth process, a state in which the second base 60 that has supported the magnetic layer 2*a* has been removed is established.

In the eighth process, after the magnetic layer 2*c* is sufficiently cured and the magnetic body 2 in which the magnetic layers 2*a*, 2*b*, and 2*c* are integrated is formed, the second base 60 is removed. With this process, the inductor device 1 is completed.

Meanwhile, the magnetic layer 2*a* is interposed between the end surfaces of the one end portions of the first conductors 3 and the second base in the third process (first conductor transfer process) and it is observed that the one end portions of the first conductors 3 are covered by the magnetic layer 2*a* after the second base 60 is removed in some cases. In this case, for example, the surface of the magnetic layer 2*a* is polished with a polishing agent softer than the metal pins as the first conductors 3 and harder than the magnetic layer 2*a*. With this, the one end portions of the first conductors 3 can be exposed to the bottom surface of the magnetic body 2 reliably.

<Variation of Inductor Device>

Variations of the inductor device 1 in the first embodiment of the present disclosure will be described with reference to FIG. 11 to FIG. 18.

Figure 11:
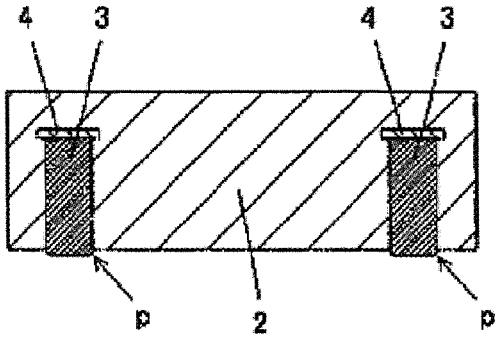
FIG. 11 is a cross-sectional view corresponding to a cross-sectional view of a plane containing a line Y1-Y1 in FIG. 1 when viewed in the arrow direction, which illustrates a first variation of the inductor device 1 in the first embodiment of the present disclosure.

FIG. 11 is a cross-sectional view corresponding to the cross-sectional view of the plane containing the line Y1-Y1 in FIG. 1 when viewed in the arrow direction, which illustrates a first variation of the inductor device 1 in the first embodiment of the present disclosure. In the cross-sectional view of the first variation illustrated in FIG. 11, the one end portions of the first conductors 3 have projecting portions p from the bottom surface of the magnetic body 2. This configuration can be provided by polishing the magnetic body 2 to an extent that the one end portions of the first conductors 3 slightly project from the bottom surface of the magnetic body 2, for example, as in the eighth process (second base removal process, see FIGS. 10A and 10B) in the above-described method for manufacturing the inductor device 1.

With this, when the one end portions of the first conductors 3 are made to function as the outer electrodes, in mounting of the inductor device 1 on a circuit substrate of an electronic apparatus, the contact area thereof with a bonding material such as solder is increased.

As a result, strength of a bonding portion is improved and reliability of the electronic apparatus including the inductor device 1 is improved.

Figure 12:
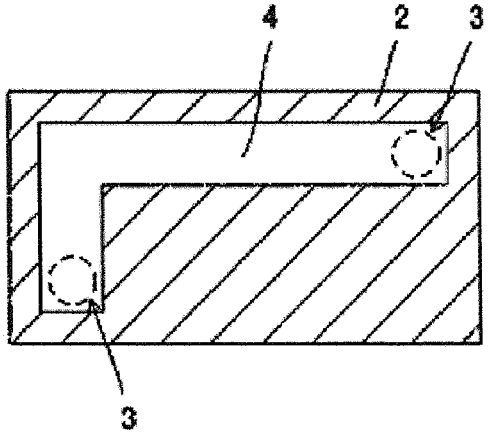
FIG. 12 is a cross-sectional view corresponding to a cross-sectional view of a plane containing a line Z1-Z1 in FIG. 1 when viewed in the arrow direction, which illustrates a second variation of the inductor device 1 in the first embodiment of the present disclosure.

FIG. 12 is a cross-sectional view corresponding to the cross-sectional view of the plane containing the line Z1-Z1 in FIG. 1 when viewed in the arrow direction, which illustrates a second variation of the inductor device 1 in the first embodiment of the present disclosure. In the second variation illustrated in FIG. 12, the first conductors 3 are arranged in the vicinity of positions on a diagonal line of the magnetic body 2 and the second conductor 4 is made shorter than that in the first embodiment.

Figure 13:
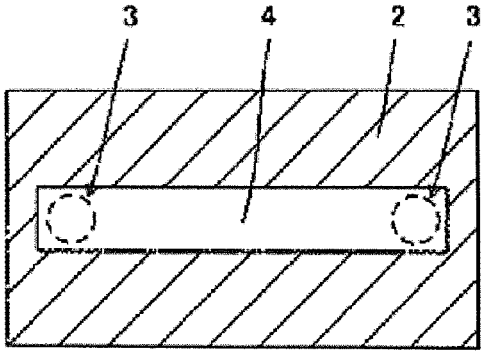
FIG. 13 is a cross-sectional view corresponding to the cross-sectional view of the plane containing the line Z1-Z1 in FIG. 1 when viewed in the arrow direction, which illustrates a third variation of the inductor device 1 in the first embodiment of the present disclosure.

FIG. 13 is a cross-sectional view corresponding to the cross-sectional view of the plane containing the line Z1-Z1 in FIG. 1 when viewed in the arrow direction, which illustrates a third variation of the inductor device 1 in the first embodiment of the present disclosure. In the third variation illustrated in FIG. 13, the second conductor 4 has a linear shape and is made much shorter than that in the first embodiment.

In an electronic circuit to which a high-frequency signal is input, an inductor device having a minute inductance value is required in some cases. By appropriately changing arrangement of the first conductors 3 and the pattern of the second conductor 4 as described in the second variation and the third variation, the minute inductance value can be obtained easily and the value thereof can be adjusted with high accuracy.

Figure 14:
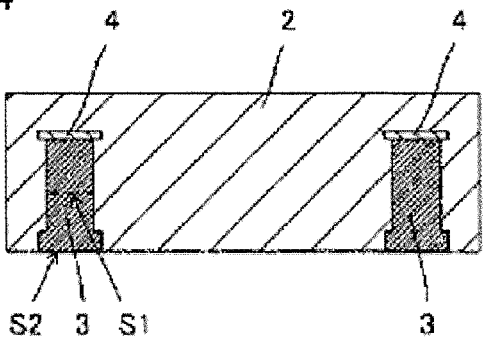
FIG. 14 is a cross-sectional view corresponding to the cross-sectional view of the plane containing the line Y1-Y1 in FIG. 1 when viewed in the arrow direction, which illustrates a fourth variation of the inductor device 1 in the first embodiment of the present disclosure.

FIG. 14 is a cross-sectional view corresponding to the cross-sectional view of the plane containing the line Y1-Y1 in FIG. 1 when viewed in the arrow direction, which illustrates a fourth variation of the inductor device 1 in the first embodiment of the present disclosure. In the fourth variation illustrated in FIG. 14, the first conductors 3 have stepped shapes in the vicinity of the bottom surface of the magnetic body 2 and areas of the end surfaces of the one end portions of the first conductors 3, which are exposed to the second main surface, are larger than the cross-sectional areas of the first conductors 3 in the magnetic body 2.

Figure 15:
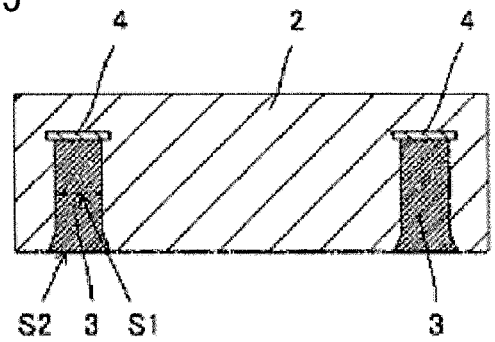
FIG. 15 is a cross-sectional view corresponding to the cross-sectional view of the plane containing the line Y1-Y1 in FIG. 1 when viewed in the arrow direction, which illustrates a fifth variation of the inductor device 1 in the first embodiment of the present disclosure.

FIG. 15 is a cross-sectional view corresponding to the cross-sectional view of the plane containing the line Y1-Y1 in FIG. 1 when viewed in the arrow direction, which illustrates a fifth variation of the inductor device 1 in the first embodiment of the present disclosure. In the fifth variation illustrated in FIG. 15, the first conductors 3 are formed into tapered shapes in the vicinity of the second main surface of the magnetic body 2 and the areas of the end surfaces of the one end portions of the first conductors 3, which are exposed to the second main surface, are larger than the cross-sectional areas of the first conductors 3 in the magnetic body 2.

In the fourth variation and the fifth variation, the areas of the end surfaces of the one end portions of the first conductors 3, which are exposed to the bottom surface of the magnetic body 2, are larger than the cross-sectional areas of the first conductors 3 in the magnetic body 2. With this, when the one end portions of the first conductors 3 are made to function as the outer electrodes, in mounting of the inductor device 1 on a circuit substrate of an electronic apparatus, the contact area thereof with a bonding material such as solder is increased.

As a result, strength of a bonding portion is improved and reliability of the electronic apparatus including the inductor device 1 is improved.

Figure 16:
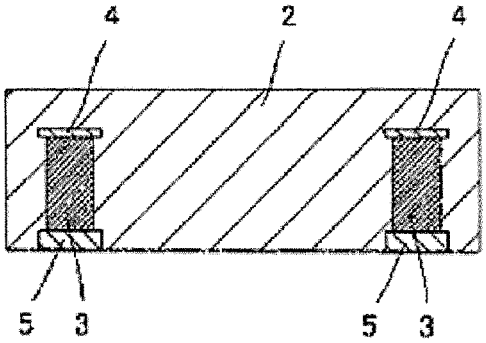
FIG. 16 is a cross-sectional view corresponding to the cross-sectional view of the plane containing the line Y1-Y1 in FIG. 1 when viewed in the arrow direction, which illustrates a sixth variation of the inductor device 1 in the first embodiment of the present disclosure.

FIG. 16 is a cross-sectional view corresponding to the cross-sectional view of the plane containing the line Y1-Y1 in FIG. 1 when viewed in the arrow direction, which illustrates a sixth variation of the inductor device 1 in the first embodiment of the present disclosure. In the sixth variation illustrated in FIG. 16, the one end portions of the first conductors 3 are connected to outer electrodes 5 provided on the second main surface of the magnetic body 2 and having areas larger than the cross-sectional areas of the first conductors 3.

Figure 17:
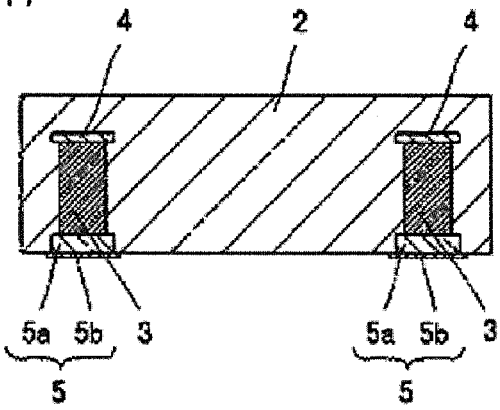
FIG. 17 is a cross-sectional view corresponding to the cross-sectional view of the plane containing the line Y1-Y1 in FIG. 1 when viewed in the arrow direction, which illustrates a seventh variation of the inductor device 1 in the first embodiment of the present disclosure.

FIG. 17 is a cross-sectional view corresponding to the cross-sectional view of the plane containing the line Y1-Y1 in FIG. 1 when viewed in the arrow direction, which illustrates a seventh variation of the inductor device 1 in the first embodiment of the present disclosure. In the seventh variation illustrated in FIG. 17, each of the outer electrodes 5 includes an underlayer 5*a* and a plated layer 5*b*. It is preferable that the plated layer 5*b* cover a portion of the underlayer 5*a*, which is exposed to the bottom surface of the magnetic body 2, and further extend to cover a part of the bottom surface of the magnetic body 2.

Figure 18:
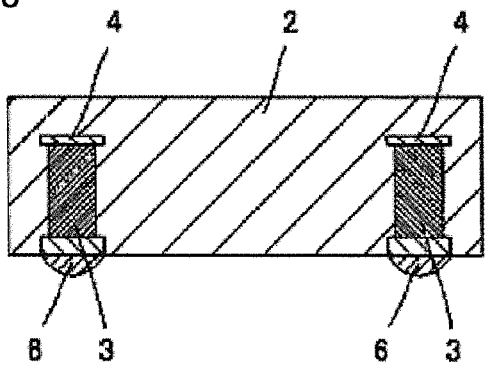
FIG. 18 is a cross-sectional view corresponding to the cross-sectional view of the plane containing the line Y1-Y1 in FIG. 1 when viewed in the arrow direction, which illustrates an eighth variation of the inductor device 1 in the first embodiment of the present disclosure.

FIG. 18 is a cross-sectional view corresponding to the cross-sectional view of the plane containing the line Y1-Y1 in FIG. 1 when viewed in the arrow direction, which illustrates an eighth variation of the inductor device 1 in the first embodiment of the present disclosure. In the eighth variation illustrated in FIG. 18, solder bumps 6 are connected to the surfaces of the outer electrodes 5.

In the sixth variation, the end portions of the first conductors are connected to the outer electrodes 5 having the areas larger than the cross-sectional areas of the first conductors. Therefore, in mounting of the inductor device 1 on a circuit substrate of an electronic apparatus, the contact area thereof with a bonding material is increased.

Furthermore, by providing the plated layers 5*b* on the surfaces of outer electrodes 5 or previously applying the bonding material such as the solder bumps 6 to the surfaces of the outer electrodes 5 as in the seventh variation or the eighth variation, the above-mentioned effect can be improved.

As a result, strength of a bonding portion is improved and reliability of the electronic apparatus including the inductor device 1 is improved.

FIG. 16 and FIG. 18 illustrate examples in which the outer electrodes 5 are formed in the magnetic body 2 and FIG. 17 illustrates an example in which the underlayers 5*a* in the outer electrodes 5 are formed in the magnetic body 2. Alternatively, the outer electrodes 5 or the underlayers 5*a* may be formed on the bottom surface of the magnetic body 2 so as to be connected to the end surfaces of the one end portions of the first conductors 3, which are exposed to the bottom surface of the magnetic body 2.

Second Embodiment of Inductor Device

The configuration and a manufacturing method of an inductor device 1 according to a second embodiment of the present disclosure will be described with reference to FIG. 19 to FIG. 26B.

<Configuration of Inductor Device>

The configuration of the inductor device 1 according to the second embodiment of the present disclosure will be described with reference to FIG. 19 and FIGS. 20A, 20B and 20C.

A method for manufacturing the inductor device 1 in the second embodiment is different in a point that the second conductor 4 includes an underlayer 4*a* and a plated layer 4*b* as will be described later but is common in other points and detail description thereof is therefore omitted. Furthermore, the variations of the first embodiment can be applied to variations of the inductor device 1 in the second embodiment and detail description thereof is also therefore omitted.

Figure 19:
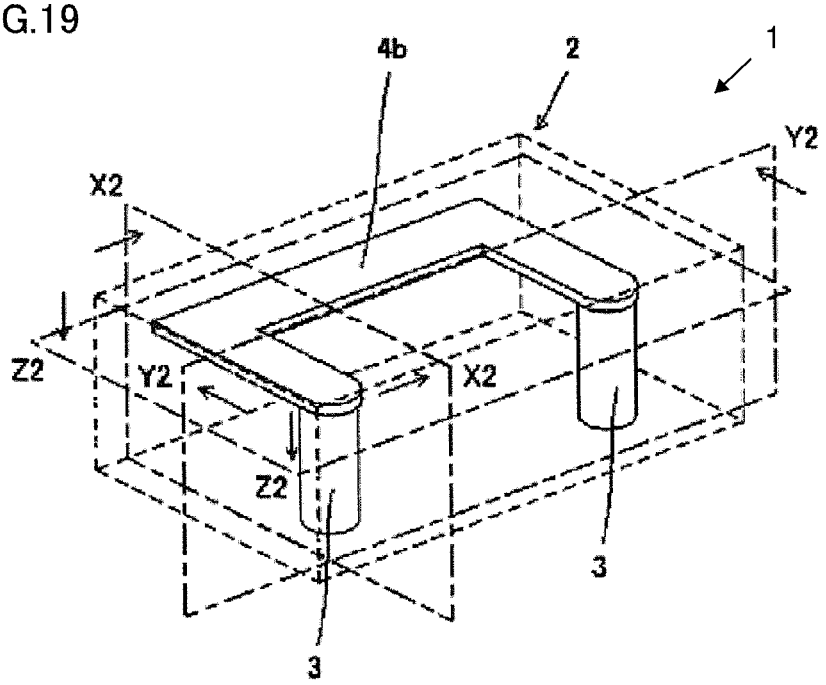
FIG. 19 is a see-through perspective view illustrating first conductors 3 and a second conductor 4 (plated layer 4*b*) while seeing through a magnetic body 2 in an inductor device 1 according to a second embodiment of the present disclosure.
Figure 20A:
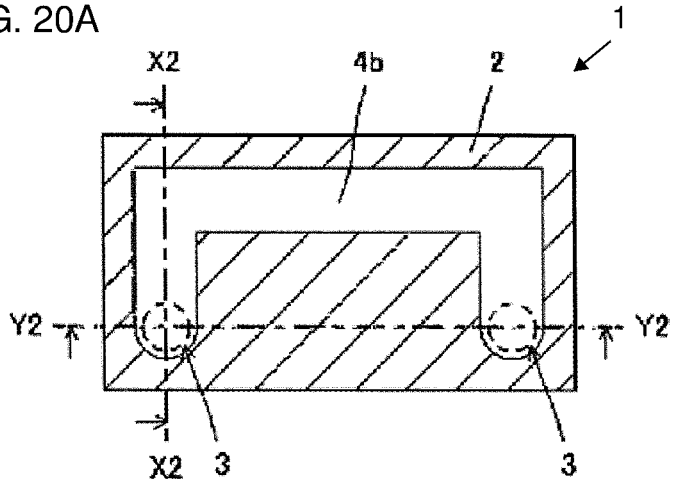
FIGS. 20A, 20B and 20C include cross-sectional views illustrating the inductor device 1 illustrated in FIG. 19 when viewed in an arrow direction.
Figure 20B:
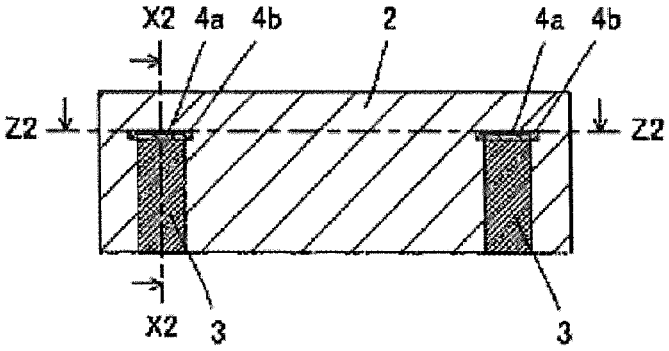
Figure 20C:
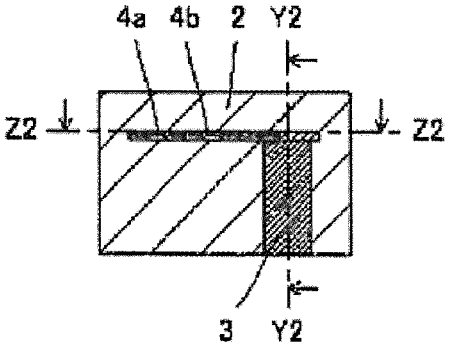

FIG. 19 is a see-through perspective view illustrating the first conductors 3 and the second conductor 4 while seeing through the magnetic body 2 in the inductor device 1 in the second embodiment of the present disclosure. FIG. 20A is a cross-sectional view of a plane containing a line Z2-Z2 in FIG. 19 when viewed in the arrow direction. FIG. 20B is a cross-sectional view of a plane containing a line Y2-Y2 in FIG. 19 when viewed in the arrow direction. FIG. 20C is a cross-sectional view of a plane containing a line X2-X2 in FIG. 19 when viewed in the arrow direction.

The inductor device 1 in the second embodiment is configured by including the magnetic body 2 and a conductor that is buried in the magnetic body 2 and has the two first conductors 3 as metal pins and the second conductor 4. The second conductor 4 includes the underlayer 4*a* as a cured product of conductive pastes and the plated layer 4*b*. As illustrated in FIG. 20C, the first conductors 3 are directly connected to both of the underlayer 4*a* and the plated layer 4*b* of the second conductor.

The magnetic body 2, the first conductors 3, and the underlayer 4*a* of the second conductor 4 in the inductor device 1 in the second embodiment can be formed using materials that are the same as those described in the first embodiment. Furthermore, the plated layer 4*b* of the second conductor 4 can be formed using Cu plating, for example.

In the above-described inductor device 1, the second conductor 4 includes the plated layer 4*b* having higher conductivity than the conductor formed with the conductive pastes. Furthermore, the plated layer 4*b* and the first conductors 3 are directly connected. Therefore, a resistance value caused by connecting portions between the first conductors 3 and the second conductor 4 can be decreased.

As a result, specific resistance of the conductor is lowered and variation thereof is reduced. In addition, heat generation at the time of energization is reduced, thereby improving reliability of the inductor device 1.

<Example of Method for Manufacturing Inductor Device>

An example of the method for manufacturing the inductor device 1 according to the second embodiment of the present disclosure will be described with reference to FIG. 21A to FIG. 26B. FIG. 21A to FIG. 26B are views schematically illustrating a first process to a sixth process that are sequentially performed in the example of the method for manufacturing the inductor device 1. In each of FIG. 21A to FIG. 26B, A corresponds to a top view and B corresponds to a cross-sectional view of a plane containing a line Y1-Y1 in A when viewed in the arrow direction as in the above-described manufacturing method.

In the following description, the same technical terms and reference numerals are applied to members corresponding to those used in the description of the method for manufacturing the inductor device 1 in the above-described first embodiment. Furthermore, materials of the respective members are equivalent to those used in the inductor device 1 in the first embodiment.

<First Process>

Figure 21A:
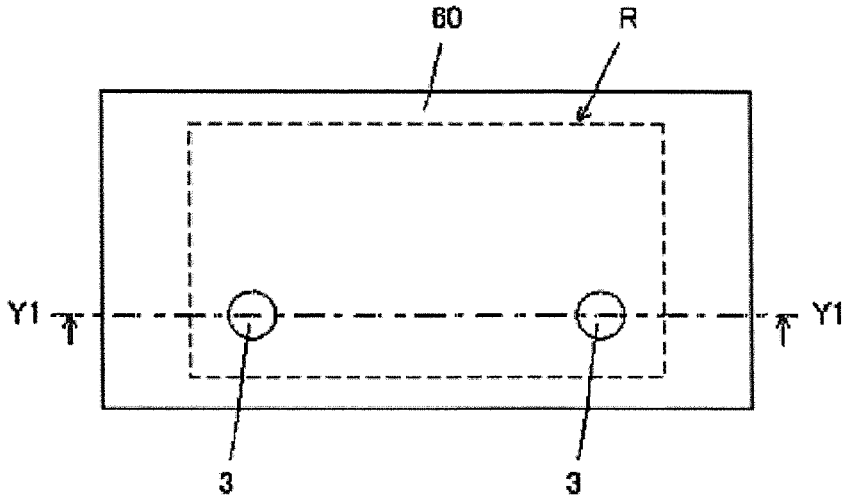
FIGS. 21A and 21B include views for explaining an example of a method for manufacturing the inductor device 1 illustrated in FIG. 19 and FIGS. 20A, 20B and 20C and schematically illustrating a first process (first conductor preparation process).
Figure 21B:
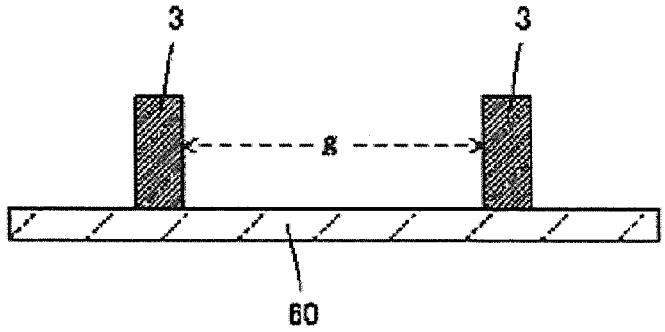

Each of FIGS. 21A and 21B is a view schematically illustrating the first process (first conductor preparation process) in the method for manufacturing the inductor device 1. With the first process, the first conductors 3 are made into a state of being temporarily supported on the second base 60.

In the first process, the first conductors 3 as the metal pins and the plate-like second base 60 on which one end portions of the first conductors 3 are temporarily supported on one main surface are prepared. A region R as indicated by a dashed line in FIG. 21A virtually expresses a position of the magnetic layer 2*b* in which the first conductors are buried in the second process (first conductor burying process), which will be described later.

Then, the two first conductors 3 are temporarily fixed onto the second base 60 so as to form a gap g therebetween with which the inductor device 1 can obtain desired inductance. The second base 60 is a member temporarily supporting the first conductors 3 in order to facilitate burying of the first conductors 3 in the magnetic layer 2*b* and is removed in the fourth process (second base removal process), which will be described later.

Therefore, a temporal adhesive member such as an adhesive sheet, for example, is provided on the surface of the second base 60 so as to enable the first conductors 3 to be temporarily fixed thereon.

It should be noted that the first conductors 3 may be temporarily supported on the first base 50, and then, be inserted into the uncured magnetic layer 2*a* supported on the surface of the second base 60 so as to be fixed by curing the magnetic layer 2*a* in the same manner the first to third processes in the method for manufacturing the inductor device 1 in the first embodiment.

<Second Process>

Figure 22A:
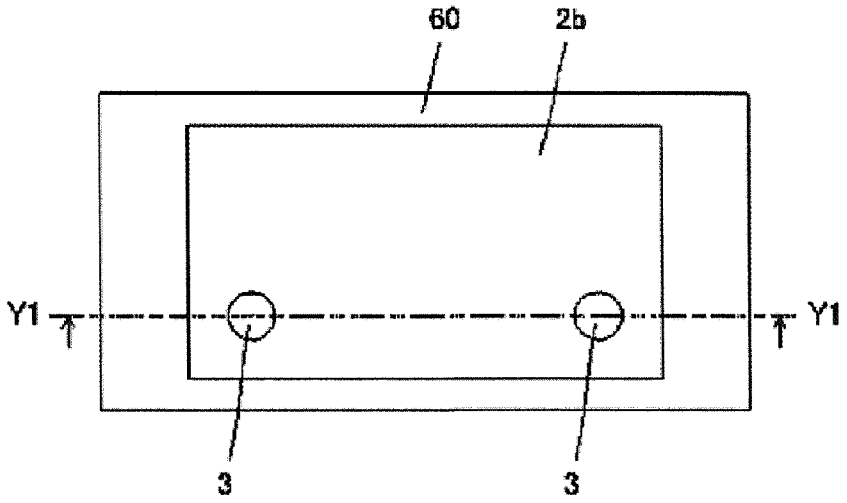
FIGS. 22A and 22B include views schematically illustrating a second process (first conductor burying process) that is executed after the first process illustrated in FIGS. 21A and 21B.
Figure 22B:
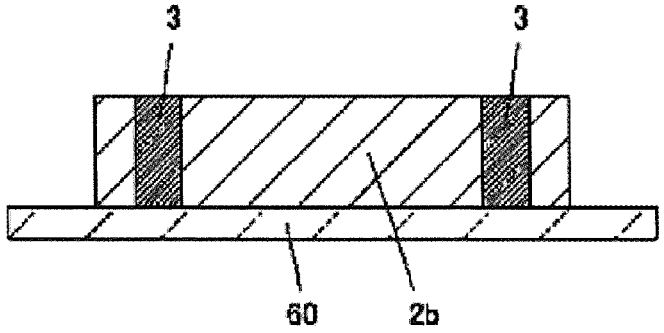

Each of FIGS. 22A and 22B is a view schematically illustrating the second process (first conductor burying process) in the method for manufacturing the inductor device 1. With the second process, the first conductors 3 are made into a state of being buried in the magnetic layer 2*b*.

In the second process, the magnetic layer 2*b* is formed on the second base 60 such that the first conductors 3 are buried therein. It should be noted that the other end portions of the first conductors 3 are exposed to the surface of the magnetic layer 2*b*.

The magnetic layer 2*b* can be formed by causing the magnetic material-containing resin in the form of liquid to flow into a frame having a predetermined shape, and then, thermally curing it. Alternatively, the magnetic layer 2*b* may be formed by placing a prepreg made of the magnetic material-containing resin, which is separately produced, on the second base 60 such that the first conductors 3 penetrate through the prepreg, and then, thermally curing it.

It should be noted that as a method for exposing the other end portions of the first conductors 3 to the surface of the magnetic layer 2*b*, a method in which overall the first conductors 3 are temporarily buried in the magnetic layer 2*b*, and then, the surface of the magnetic layer 2*b* is polished until the other end portions of the first conductors 3 are exposed may be employed.

The polishing method in the fifth process in the method for manufacturing the inductor device 1 in the first embodiment can be applied to the polishing, for example. In this case, the other end portions of the first conductors 3 can be exposed to the surface of the magnetic layer 2*b* reliably. Furthermore, the first conductors 3 and the magnetic layer 2*b* may be polished together. In this case, in addition to the above-described effect, the inductor device 1 can be made to have a dimension in a range of a predetermined dimension by adjusting the thickness thereof.

<Third Process>

Figure 23A:
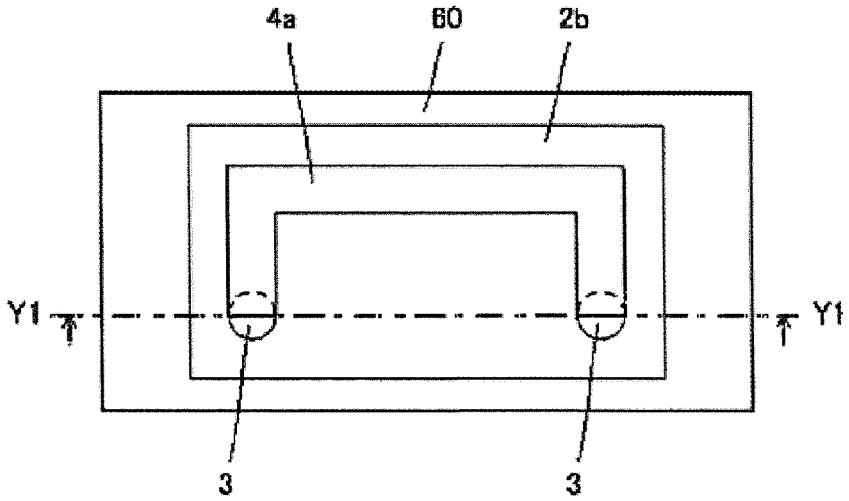
FIGS. 23A and 23B include views schematically illustrating a third process (second conductor underlayer formation process) that is executed after the second process illustrated in FIGS. 22A and 22B.
Figure 23B:
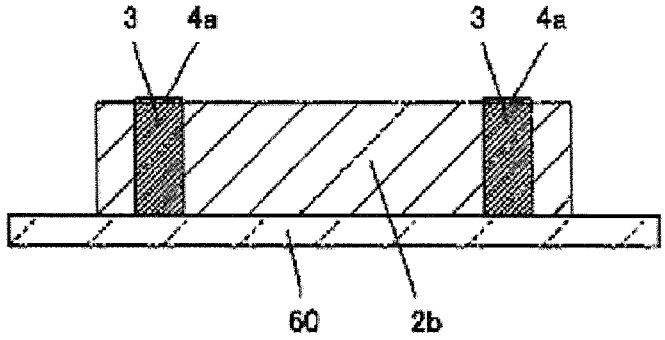

Each of FIGS. 23A and 23B is a view schematically illustrating the third process (second conductor underlayer formation process) in the method for manufacturing the inductor device 1. With the third process, the underlayer 4*a* of the second conductor 4, which has a predetermined pattern, is made into a state of being connected to the first conductors 3.

In the third process, the underlayer 4*a* which is connected to the other end portions of the first conductors 3 and has the predetermined pattern is formed on the cured magnetic layer 2*b*. The underlayer 4*a* is a base member for forming the plated layer 4*b* in the fifth process (second conductor plated layer formation process), which will be described later.

The underlayer 4*a* is formed into the predetermined pattern using a method for application and cure of conductive pastes using Cu or the like as metal filler, for example, application and low-temperature sinter of Ag nanoparticle pastes, sputtering, or the like.

The pattern formation of the underlayer 4*a* on the magnetic layer 2*b* in the third process is performed equivalently to the sixth process (second conductor formation process, see FIGS. 8A and 8B) in the method for manufacturing the inductor device 1 in the above-described first embodiment. In this case, it is preferable that an end portion of the pattern of the underlayer 4*a* cover a part of the end surfaces of the other end portions of the first conductors 3, for example, approximately half the end surfaces (see, fifth process (second conductor plated layer formation process), which will be described later).

<Fourth Process>

Figure 24A:
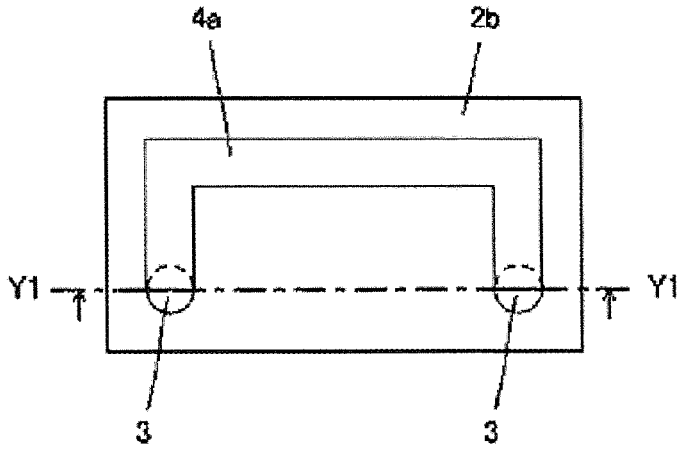
FIGS. 24A and 24B include views schematically illustrating a fourth process (second base removal process) that is executed after the third process illustrated in FIGS. 23A and 23B.
Figure 24B:
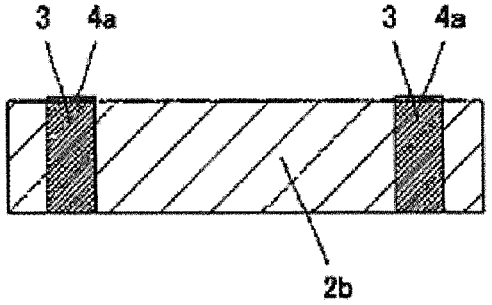

Each of FIGS. 24A and 24B is a view schematically illustrating the fourth process (second base removal process) in the method for manufacturing the inductor device 1. With the fourth process, a state in which the second base 60 that has temporarily fixed the first conductors 3 has been removed is established.

In the fourth process, after the first conductors 3 are made into the state of being buried in the magnetic layer 2*b*, the second base 60 that has finished its role is removed from the magnetic layer 2*b*.

After the second base 60 is removed, it is observed that the one end portions of the first conductors 3 are covered by the adhesive member for temporarily fixing the first conductors 3 in some cases. In this case, the one end portions of the first conductors 3 may be exposed to the bottom surface of the magnetic body 2 reliably by polishing the surface of the magnetic layer 2*b* from which the second base 60 has been removed.

In the example of the method for manufacturing the inductor device 1, the fourth process is executed after the above-described third process. However, the underlayer 4*a* may be formed in the third process after the second base 60 is removed in the fourth process.

<Fifth Process>

Figure 25A:
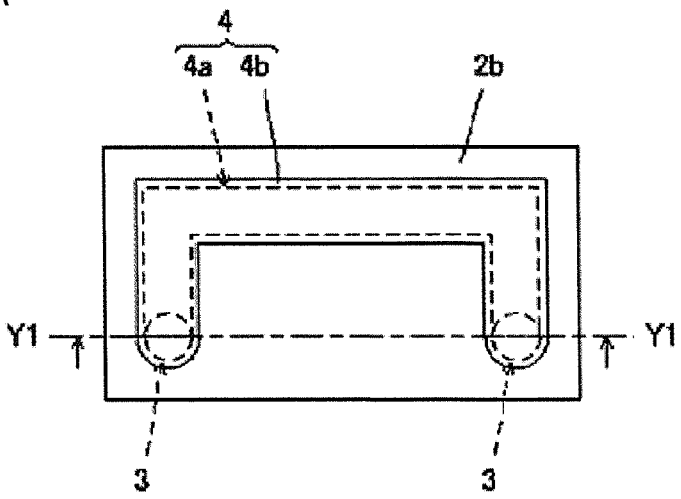
FIGS. 25A and 25B include views schematically illustrating a fifth process (second conductor plated layer formation process) that is executed after the fourth process illustrated in FIGS. 24A and 24B.
Figure 25B:
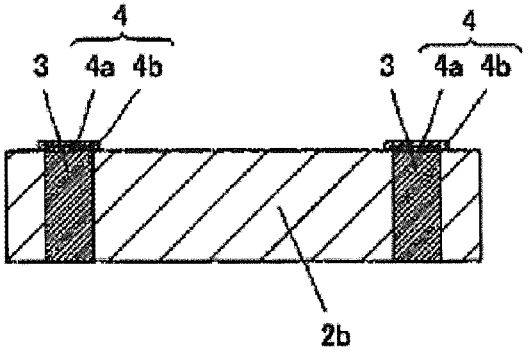

Each of FIGS. 25A and 25B is a view schematically illustrating the fifth process (second conductor plated layer formation process) in the method for manufacturing the inductor device 1. With the fifth process, a state in which the second conductor 4 connecting the two first conductors 3 has been formed is established.

In the fifth process, the plated layer 4*b* of a shape following the underlayer 4*a* having the predetermined pattern is formed while the underlayer 4*a* serves as the base member. The plated layer 4*b* may be formed using any of electrolytic plating and electroless plating. As the material of the plated layer 4*b*, for example, Cu, Ag, alloy thereof, or the like can be used.

The plated layer 4*b* is formed in the fifth process by growing the plated layer 4*b* on the end surfaces of the other end portions of the first conductors 3, which are not covered by the underlayer 4*a*, and the underlayer 4*a*. In this case, it is preferable that the plated layer 4*b* cover overall the exposed surface including the side surfaces of the underlayer 4*a*. With this, the first conductors 3 can be directly connected to both of the underlayer 4*a* and the plated layer 4*b* of the second conductor.

When the electrolytic plating is used, a plated product having a predetermined thickness is made to grow on the exposed surface of the underlayer 4*a* by supplying power from the one end portions of the first conductors 3, which have been exposed by removal of the second base 60, thereby forming the plated layer 4*b*.

It should be noted that a power supply conductor pattern (not illustrated) which is connected to the one end portions of the first conductors 3 may be formed on the surfaces of the first conductors 3. In this case, power supply to the underlayer 4*a* is performed reliably, thereby forming the plated layer 4*b* efficiently. The power supply conductor pattern is formed so as to be a predetermined pattern having an area larger than the total of the cross-sectional areas of the exposed first conductors 3 using conductive pastes using Cu or the like as metal filler in the same manner as the underlayer 4*a*.

When the electroless plating is used, a catalyst is previously applied to the exposed surface of the underlayer 4*a* and a plated product having a predetermined thickness is made to grow on the applied portion, thereby forming the plated layer 4*b*.

When the plated layer 4*b* is formed using the electroless plating in the fifth process, the fourth process (second base removal process) may be executed after the fifth process.

<Sixth Process>

Figure 26A:
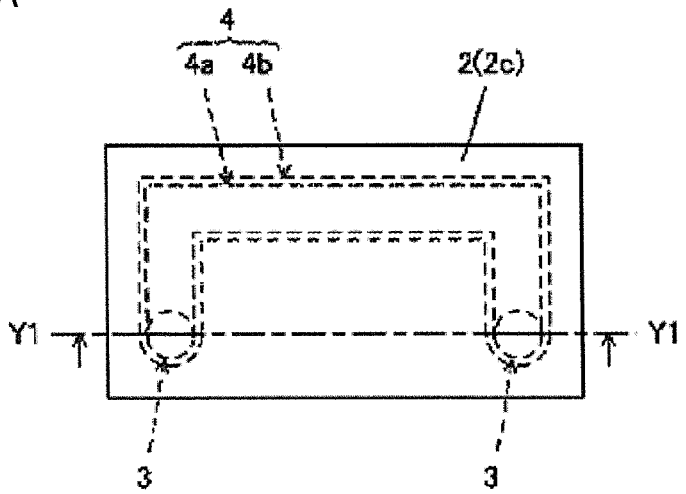
FIGS. 26A and 26B include views schematically illustrating a sixth process (second conductor burying process) that is executed after the fifth process illustrated in FIGS. 25A and 25B.
Figure 26B:
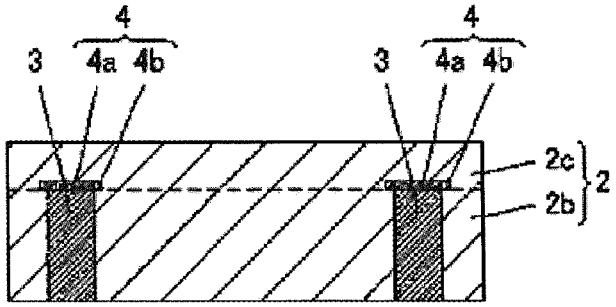

Each of FIGS. 26A and 26B is a view schematically illustrating the sixth process (second conductor burying process) in the method for manufacturing the inductor device 1. With the sixth process, the first conductors 3 and the second conductor 4 are made into a state of being buried in the magnetic body 2 including the magnetic layers 2*b* and 2*c*.

In the sixth process, the magnetic layer 2*c* is formed on the cured magnetic layer 2*b* using the same magnetic material-containing resin as the magnetic layer 2*b* by the same formation method. With this process, the first conductors 3 and the second conductor 4 are made into the state of being buried in the magnetic body 2 in which the magnetic layers 2*b* and 2*c* are integrated.

The magnetic layer 2*b* and the magnetic layer 2*c* may be formed by different methods. Furthermore, the magnetic layer 2*b* and the magnetic layer 2*c* may be formed using magnetic material-containing resins of different types.

It should be noted that after the sixth process, at least one of the upper surface and the lower surface of the magnetic body 2 may be polished if necessary so as to cause the inductor device 1 to have a dimension in the range of the predetermined dimension by adjusting the thickness thereof.

<Another Example of Method for Manufacturing Inductor Device>

Another example of the method for manufacturing the inductor device 1 in the second embodiment of the present disclosure will be described with reference to FIG. 27A to FIG. 34B. FIG. 27A to FIG. 34B are views schematically illustrating a first process to an eighth process that are sequentially performed in another example of the method for manufacturing the inductor device 1. In each of FIG. 27A to FIG. 34B, A corresponds to a top view and B corresponds to a cross-sectional view of a plane containing a line Y1-Y1 in A when viewed in the arrow direction as in the above-described manufacturing method.

In the following description, the same technical terms and reference numerals are applied to members corresponding to those used in the above description of the manufacturing method. Furthermore, materials of the respective members are equivalent to those used in the inductor device 1 in the above-described embodiments.

<First Process>

Figure 27A:
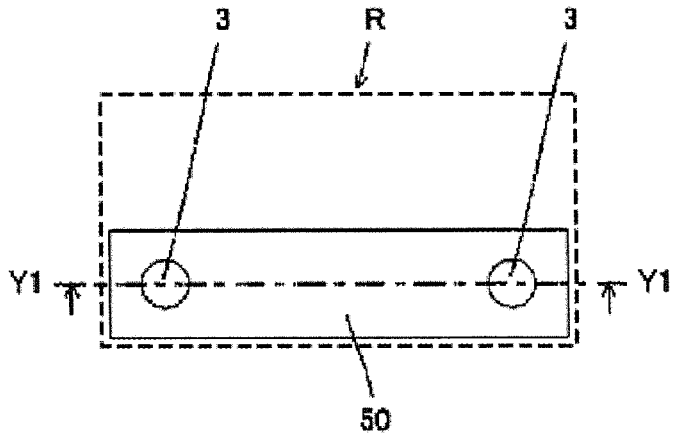
FIGS. 27A and 27B include views for explaining another example of the method for manufacturing the inductor device 1 illustrated in FIG. 19 and FIGS. 20A, 20B and 20C and schematically illustrating a first process (first conductor preparation process).
Figure 27B:
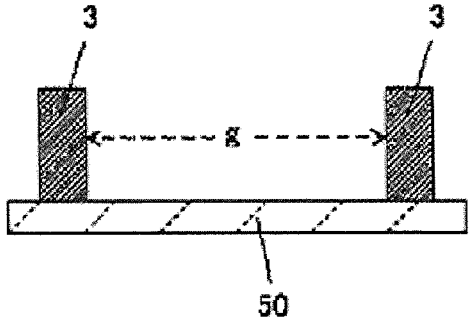

Each of FIGS. 27A and 27B is a view schematically illustrating the first process (first conductor preparation process) in the method for manufacturing the inductor device 1. With the first process, the first conductors 3 are made into a state of being temporarily supported on the first base 50. This process is equivalent to the first process in the method for manufacturing the inductor device 1 in the first embodiment.

<Second Process>

Figure 28A:
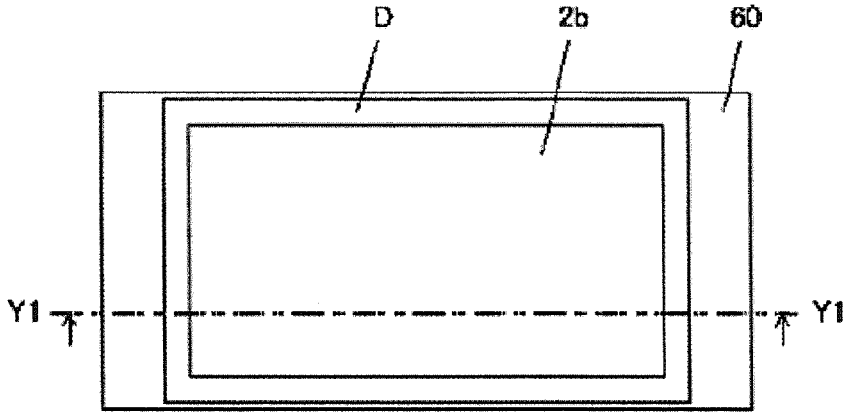
FIGS. 28A and 28B include views schematically illustrating a second process (first conductor-burying magnetic layer preparation process) that is executed after the first process illustrated in FIGS. 27A and 27B.
Figure 28B:
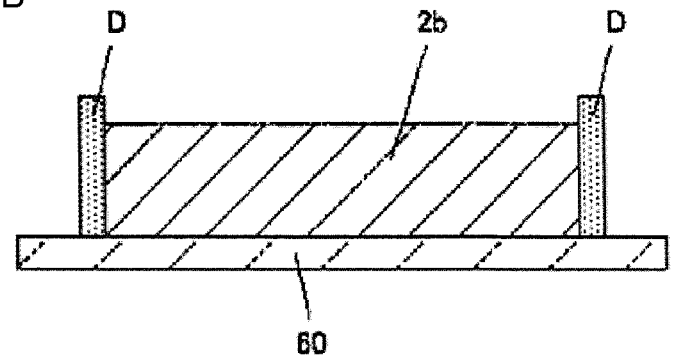

Each of FIGS. 28A and 28B is a view schematically illustrating the second process (first conductor-burying magnetic layer preparation process) in the method for manufacturing the inductor device 1. With the second process, an uncured product of the magnetic layer 2*b* in which the first conductors 3 are buried is made into the state of being supported on the second base 60.

In the second process, the plate-like second base 60 supporting the uncured magnetic layer 2*b* on one main surface thereof and a dam D installed on the second base 60 for preventing the uncured magnetic layer 2*b* from flowing are prepared. The uncured magnetic layer 2*b* can be prepared by causing the above-described magnetic material-containing resin in the form of liquid to flow into a frame formed by the above-described second base 60 and the dam D. Alternatively, the uncured magnetic layer 2*b* may be prepared by placing a prepreg made of the magnetic material-containing resin, which is separately produced, on the second base 60.

<Third Process>

Figure 29A:
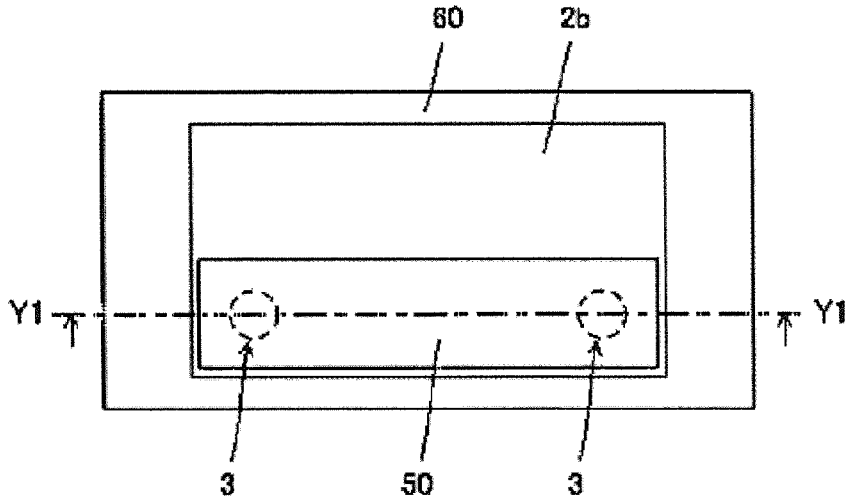
FIGS. 29A and 29B include views schematically illustrating a third process (first conductor burying process) that is executed after the second process illustrated in FIGS. 28A and 28B.
Figure 29B:
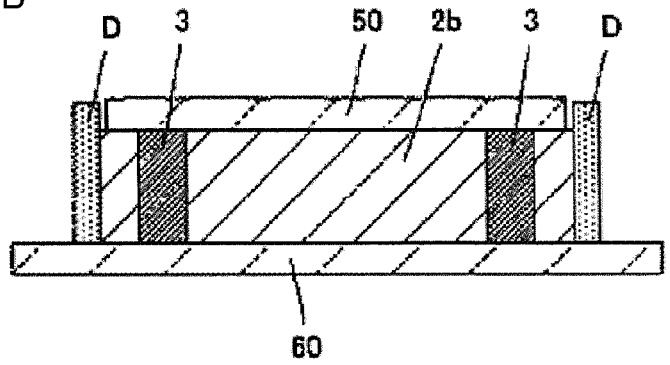

Each of FIGS. 29A and 29B is a view schematically illustrating the third process (first conductor burying process) in the method for manufacturing the inductor device 1. With the third process, the first conductors 3 are made into a state of being buried in the magnetic layer 2*b* while the other end portions of the first conductors 3 are temporarily fixed to the first base 50.

In the third process, first, the first conductors 3 are inserted into the uncured magnetic layer 2*b* until one end portions of the two first conductors 3 abut against the second base 60. In this state, the magnetic layer 2*b* is thermally cured. With this process, the first conductors 3 are made into a state of being buried in the cured magnetic layer 2*b*.

<Fourth Process>

Figure 30A:
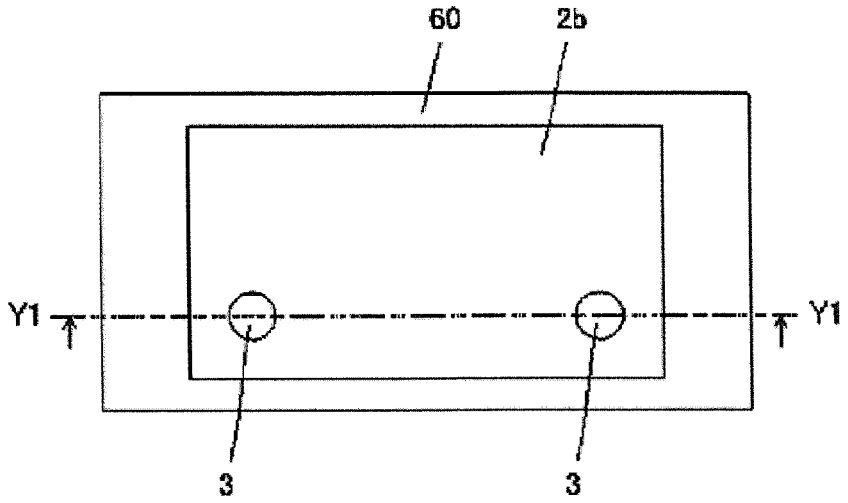
FIGS. 30A and 30B include views schematically illustrating a fourth process (first base removal process) that is executed after the third process illustrated in FIGS. 29A and 29B.
Figure 30B:
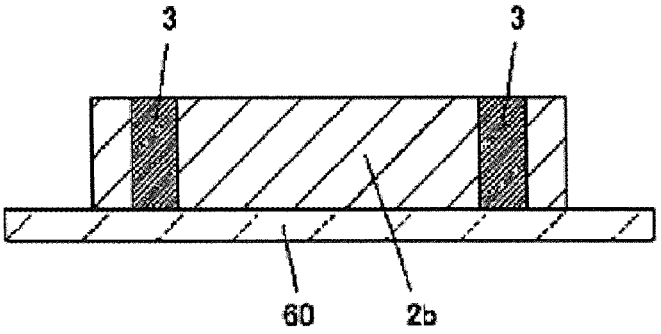

Each of FIGS. 30A and 30B is a view schematically illustrating the fourth process (first base removal process) in the method for manufacturing the inductor device 1. With the fourth process, a state in which the first base 50 that has temporarily fixed the first conductors 3 has been removed is established.

In the fourth process, after the first conductors 3 are made into the state of being buried in the sufficiently cured magnetic layer 2*b*, the first base 50 and the dam D that have finished their roles are removed from the other end portions of the first conductors 3.

<Fifth Process>

Figure 31A:
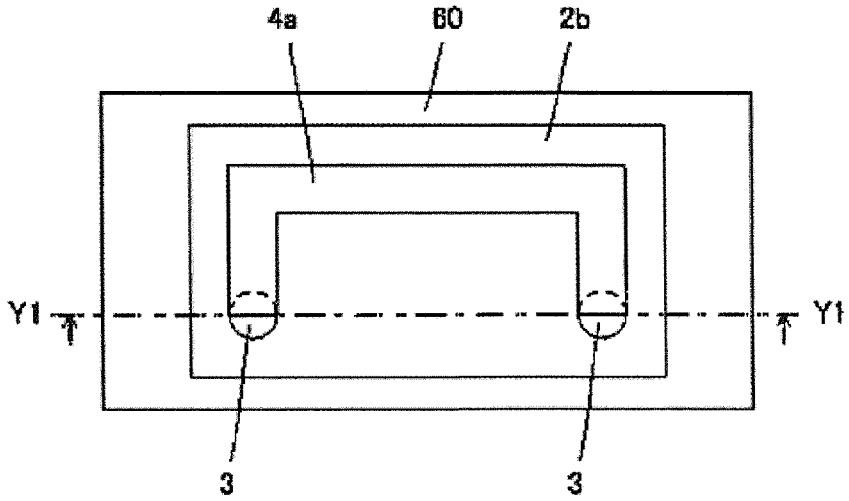
FIGS. 31A and 31B include views schematically illustrating a fifth process (second conductor underlayer formation process) that is executed after the fourth process illustrated in FIGS. 30A and 30B.
Figure 31B:
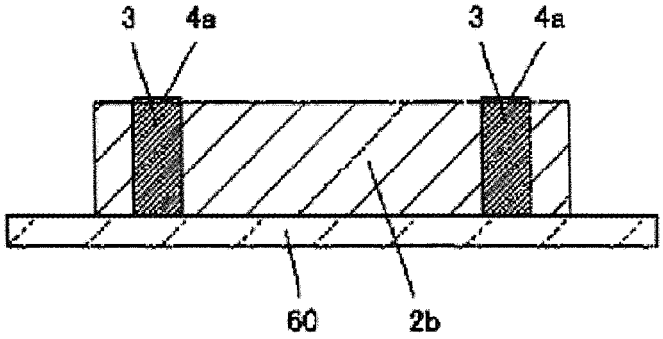

Each of FIGS. 31A and 31B is a view schematically illustrating the fifth process (second conductor underlayer formation process) in the method for manufacturing the inductor device 1. With the fifth process, the underlayer 4*a* of the second conductor 4, which has the predetermined pattern, is made into a state of being connected to the first conductors 3.

In the fifth process, the underlayer 4*a* which is connected to the other end portions of the first conductors 3 and has the predetermined pattern is formed on the cured magnetic layer 2*b*. The underlayer 4*a* is a base member for forming the plated layer 4*b* in the seventh process (second conductor plated layer formation process), which will be described later. This process is equivalent to the third process in the example of the method for manufacturing the inductor device 1 in the second embodiment.

<Sixth Process>

Figure 32A:
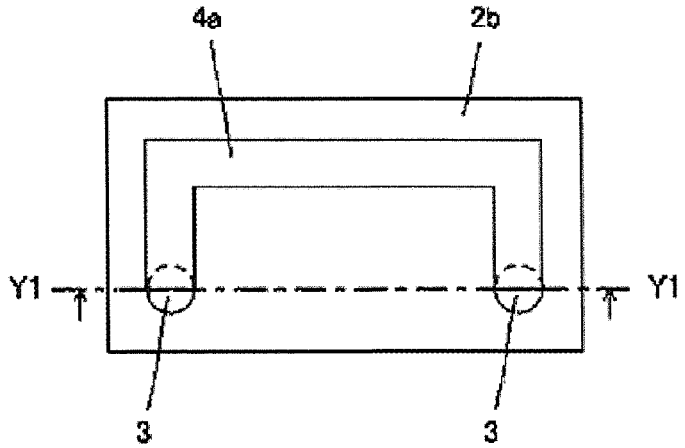
FIGS. 32A and 32B include views schematically illustrating a sixth process (second base removal process) that is executed after the fifth process illustrated in FIGS. 31A and 31B.
Figure 32B:
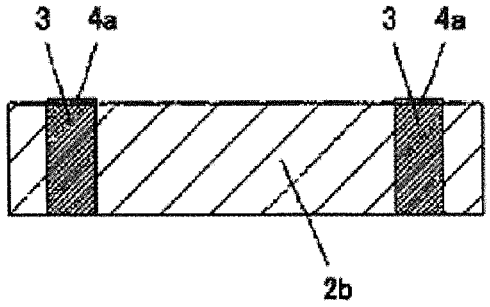

Each of FIGS. 32A and 32B is a view schematically illustrating a sixth process (second base removal process) in the method for manufacturing the inductor device 1. With the sixth process, a state in which the second base 60 and the dam D that have supported the uncured magnetic layer 2*b* have been removed from the magnetic layer 2*b* is established.

In the sixth process, after the first conductors 3 are made into the state of being buried in the magnetic layer 2*b*, the second base 60 and the dam D that have finished their roles are removed from the magnetic layer 2*b*.

The magnetic layer 2*b* is interposed between the end surfaces of the one end portions of the first conductors 3 and the second base 60 in the third process (first conductor burying process) and it is observed that the one end portions of the first conductors 3 are covered by the magnetic layer 2*b* after the second base 60 is removed in some cases. In this case, the one end portions of the first conductors 3 may be exposed to the bottom surface of the magnetic body 2 reliably by polishing the surface of the magnetic layer 2*b* from which the second base 60 has been removed.

In another example of the method for manufacturing the inductor device 1, the sixth process is executed after the above-described fifth process. However, the sixth process may be performed subsequently to the third process so as to remove the second base 60 and the dam D before the first base 50 is removed in the fourth process. Alternatively, the sixth process may be performed subsequently to the fourth process so as to remove the second base 60 and the dam D in the sixth process before the underlayer 4*a* is formed in the fifth process.

<Seventh Process>

Figure 33A:
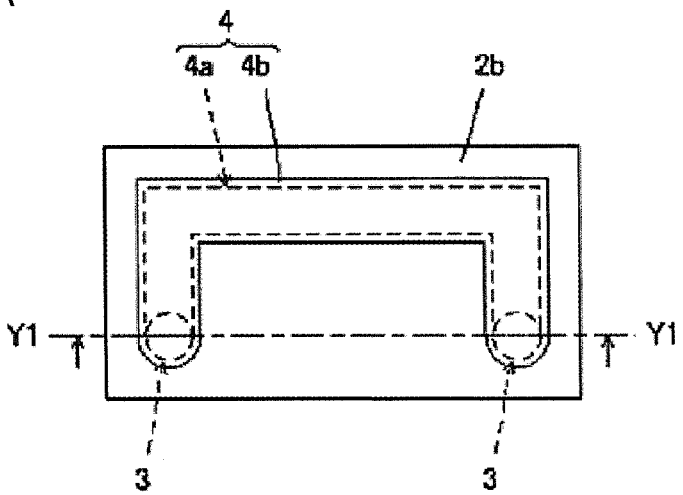
FIGS. 33A and 33B include views schematically illustrating a seventh process (second conductor plated layer formation process) that is executed after the sixth process illustrated in FIGS. 32A and 32B.
Figure 33B:
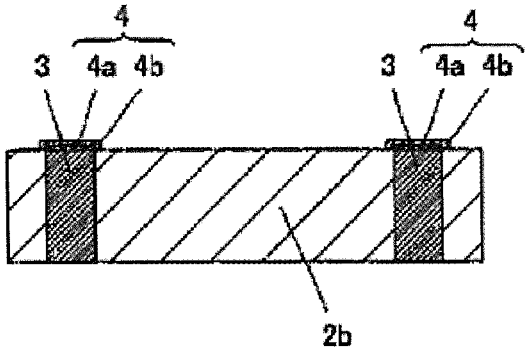

Each of FIGS. 33A and 33B is a view schematically illustrating the seventh process (second conductor plated layer formation process) in the method for manufacturing the inductor device 1. With the seventh process, a state in which the second conductor 4 connecting the two first conductors 3 has been formed is established.

In the seventh process, the plated layer 4*b* of a shape following the underlayer 4*a* having the predetermined pattern is formed while the underlayer 4*a* serves as a base member. This process is equivalent to the fifth process in the example of the method for manufacturing inductor device 1 in the second embodiment.

<Eighth Process>

Figure 34A:
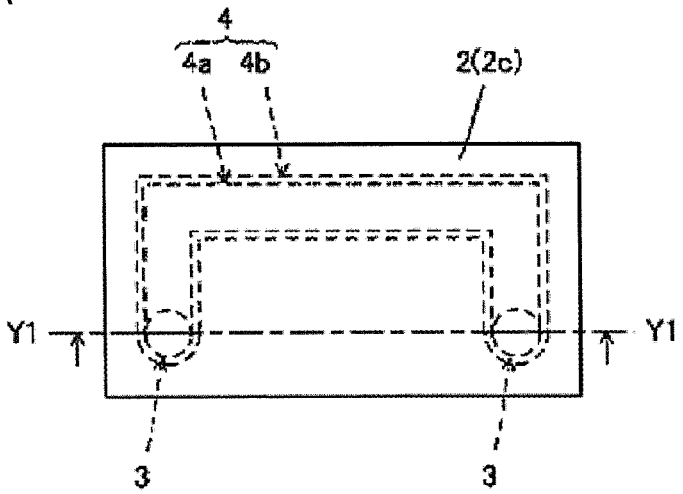
FIGS. 34A and 34B include views schematically illustrating an eighth process (second conductor burying process) that is executed after the seventh process illustrated in FIGS. 33A and 33B.
Figure 34B:
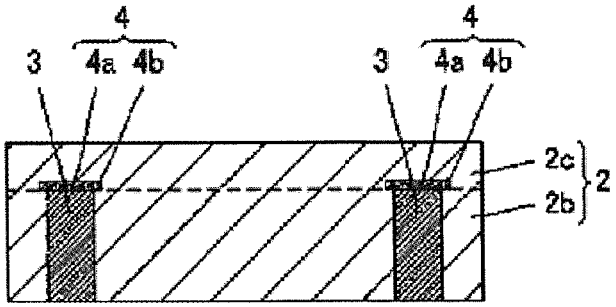

Each of FIGS. 34A and 34B is a view schematically illustrating the eighth process (second conductor burying process) in the method for manufacturing the inductor device 1. With the eighth process, the first conductors 3 and the second conductor 4 are made into a state of being buried in the magnetic body 2 including the magnetic layers 2*b* and 2*c*.

In the eighth process, the magnetic layer 2*c* is formed on the cured magnetic layer 2*b* using the same magnetic material-containing resin as the magnetic layer 2*b* by the same formation method. With this process, the first conductors 3 and the second conductor 4 are made into the state of being buried in the magnetic body 2 in which the magnetic layers 2*b* and 2*c* are integrated. This process is equivalent to the sixth process in the example of the method for manufacturing the inductor device 1 in the second embodiment.

Third Embodiment of Inductor Device

The configuration of the inductor device 1 according to a third embodiment of the present disclosure will be described with reference to FIG. 35 and FIGS. 36A, 36B and 36C.

The method for manufacturing the inductor device 1 in the third embodiment is different in a point that a conductor is formed by one bent metal pin in which the first conductors 3 and the second conductor 4 are integrated as will be described later.

In this case, temporal fixing of the conductor equivalent to the above-described first process (first conductor preparation process, see FIGS. 3A and 3B) can be performed by supporting a portion of the conductor, which corresponds to the second conductor 4, on one main surface of the first base 50. Furthermore, the conductor can be buried in the magnetic body 2 by performing the above-described fifth process (first conductor burying process, see FIGS. 7A and 7B) and seventh process (second conductor burying process, see FIGS. 9A and 9B) at a time.

Accordingly, with the inductor device 1 in the third embodiment, the formation process and the burying process of the conductor can be simplified, thereby manufacturing the inductor device 1 at low cost.

It should be noted that the variations of the first embodiment can be applied to variations of the inductor device 1 in the third embodiment and detail description thereof is therefore omitted.

Figure 35:
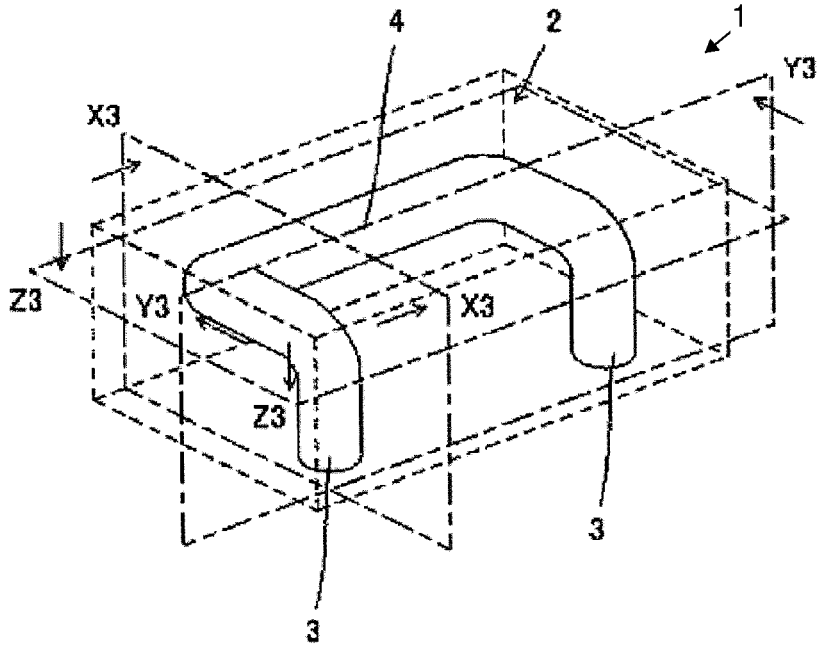
FIG. 35 is a see-through perspective view illustrating one bent metal pin in which first conductors and a second conductor are integrated while seeing through a magnetic body 2 in an inductor device 1 according to a third embodiment of the present disclosure.
Figure 36A:
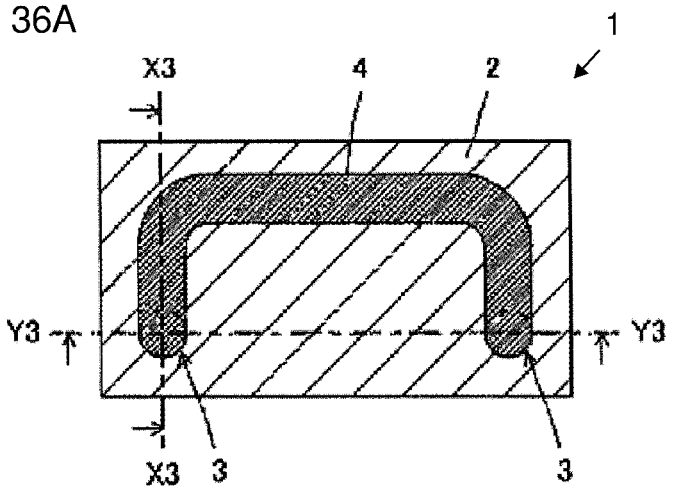
FIGS. 36A, 36B and 36C include cross-sectional views illustrating the inductor device 1 illustrated in FIG. 35 when viewed in an arrow direction.
Figure 36B:
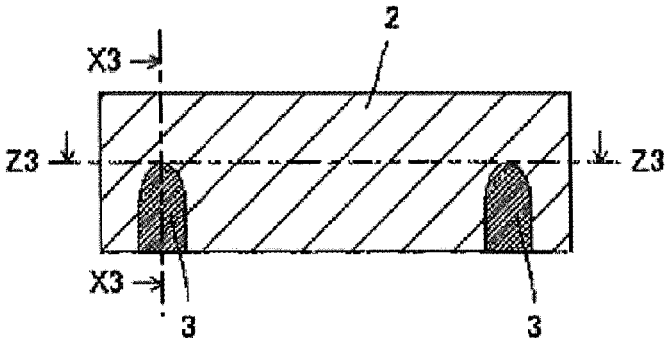
Figure 36C:
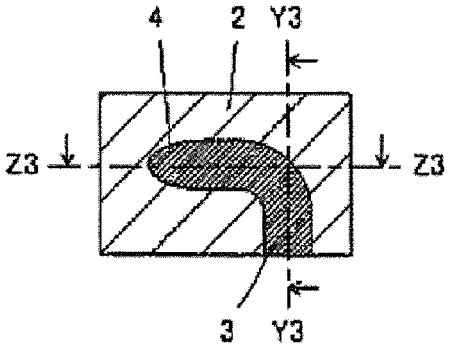

FIG. 35 is a see-through perspective view illustrating the first conductors 3 and the second conductor 4 while seeing through the magnetic body 2 in the inductor device 1 in the third embodiment of the present disclosure. FIG. 36A is a cross-sectional view of a plane containing a line Z3-Z3 in FIG. 35 when viewed in the arrow direction. FIG. 36B is a cross-sectional view of a plane containing a line Y3-Y3 in FIG. 35 when viewed in the arrow direction. FIG. 36C is a cross-sectional view of a plane containing a line X3-X3 in FIG. 35 when viewed in the arrow direction.

In the above-described inductor device 1, the conductor is formed by bending one metal pin such that portions corresponding to the first conductors 3 and the second conductor 4 are formed previously. The metal pin can be made of the same material of the metal pins as the first conductors 3 described in the first embodiment, for example, can be made of Cu, Cu alloy such as Cu—Ni alloy, Fe, or the like.

That is to say, also in the third embodiment, the metal pin is provided as a metal wire which previously has a predetermined shape when the inductor device 1 is manufactured. Accordingly, the conductor is formed by the integral metal pin with no connecting portion between the first conductors 3 and the second conductor 4. Therefore, no resistance value caused by the connecting portion is generated.

As a result, specific resistance of the conductor is lowered and variation thereof is reduced. In addition, heat generation at the time of energization is reduced, thereby improving reliability of the inductor device 1.

First Embodiment of Inductor Array

The configuration of an inductor array 10 according to a first embodiment of the present disclosure will be described with reference to FIG. 37.

Figure 37:
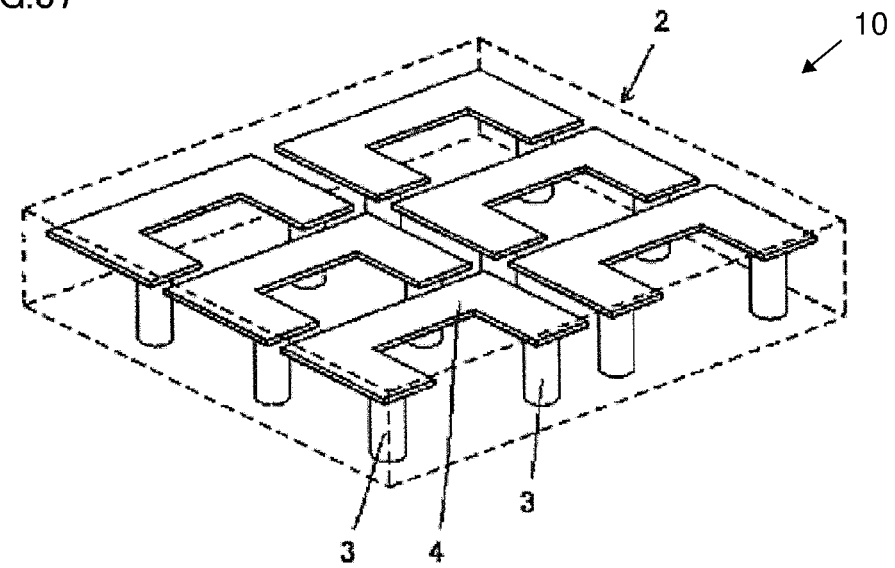
FIG. 37 is a see-through perspective view illustrating first conductors 3 and second conductors 4 while seeing through a magnetic body 2 in an inductor array 10 according to a first embodiment of the present disclosure.

FIG. 37 is a see-through perspective view illustrating the first conductors 3 and the second conductors 4 while seeing through the magnetic body 2 in the inductor array 10 in the first embodiment of the present disclosure.

FIG. 37 illustrates the inductor array including a plurality of inductors in which the first conductors 3 are the metal pins and the first conductors 3 and the second conductors 4 are separate members. That is to say, FIG. 37 corresponds to the inductor array in which the plurality of inductor devices 1 (see FIG. 1) in the first embodiment of the present disclosure are integrated.

Accordingly, the above-described inductor array 10 can be manufactured by burying a conductor group in the magnetic body 2 in accordance with the method for manufacturing the inductor device 1 in the first embodiment of the present disclosure.

In this embodiment, in the inductor array 10, the magnetic body 2 is formed into a rectangular parallelepiped shape with a top surface as a first main surface and a bottom surface as a second main surface each having a rectangular shape, which oppose each other, and four side surfaces connecting the top surface and the bottom surface. It should be noted that the shape of the magnetic body 2 is not limited to the above-described rectangular parallelepiped shape. It is sufficient that the shape is a flat plate shape with a top surface and a bottom surface each having a predetermined shape, which oppose each other, and the arbitrary number of side surfaces each having an arbitrary shape, which connect the top surface and the bottom surface.

The metal pins as the first conductors 3 are alternatives of through-hole conductors or via conductors provided so as to be perpendicular to the top surface and the bottom surface of the magnetic body in the existing inductor array. Furthermore, the end surfaces of one end portions of the first conductors 3 are exposed to the bottom surface of the magnetic body 2 so as to function as outer electrodes of the inductor array 10.

In the above-described inductor array 10, the first conductors 3 are not required to be formed by application of plating films to inner side surfaces of through-holes, filling of the through-holes with conductive pastes, or via-fill plating unlike the existing inductor array.

Therefore, the first conductors 3 can be formed with high accuracy. Furthermore, the second conductors 4 can be formed efficiently by printing of conductive pastes, for example. Moreover, defects inside the conductor such as an unfilled portion with conductive pastes, a plating unformed portion, and a lamination displaced portion, are not generated in the first conductors 3.

As a result, the above-described inductor array 10 enables a distance between the conductors to be reduced in comparison with the existing inductor array, thereby reducing the inductor array 10 in size. Moreover, specific resistances of the conductors are lowered and variations thereof are reduced. In addition, heat generation at the time of energization is reduced, thereby improving reliability of the inductor array 10.

Second Embodiment of Inductor Array

The configuration of the inductor array 10 according to a second embodiment of the present disclosure will be described with reference to FIG. 38.

Figure 38:
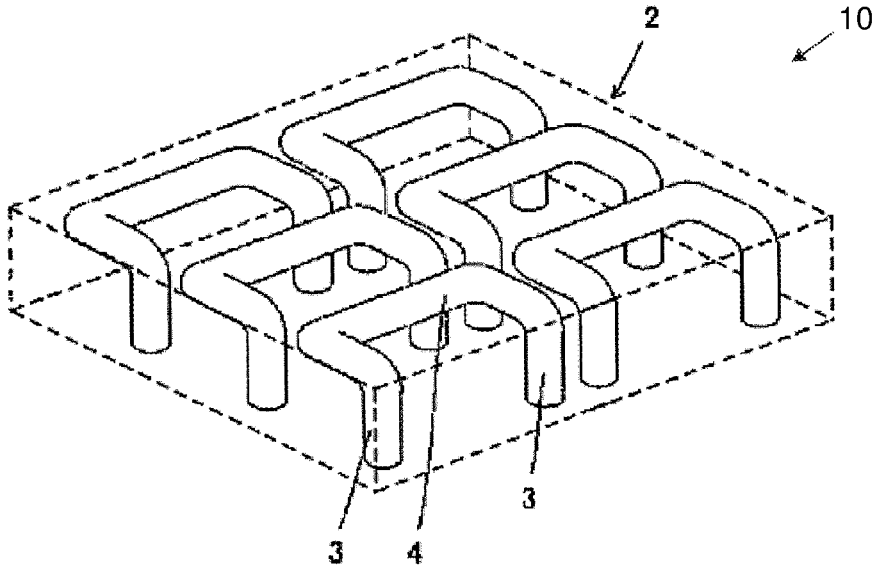
FIG. 38 is a see-through perspective view illustrating first conductors 3 and second conductors 4 while seeing through a magnetic body 2 in an inductor array 10 according to a second embodiment of the present disclosure.

FIG. 38 is a see-through perspective view illustrating the first conductors 3 and the second conductors 4 while seeing through the magnetic body 2 in the inductor array 10 in the second embodiment of the present disclosure.

FIG. 38 illustrates the inductor array including a plurality of inductors in which the conductors are formed by bending one metal pins and the first conductors 3 and the second conductors 4 are integrated. That is to say, FIG. 38 corresponds to the inductor array in which the plurality of inductor devices 1 in the third embodiment (see FIG. 35) of the present disclosure are integrated.

Accordingly, the above-described inductor array 10 can be manufactured by burying a conductor group in the magnetic body 2 in accordance with the method for manufacturing the inductor device 1 in the third embodiment of the present disclosure.

It should be noted that the shape and the outer electrodes of the above-described inductor array 10 are the same as those in the first embodiment and description thereof is therefore omitted.

In the above-described inductor array 10, the conductors are formed by bending one metal pins such that portions corresponding to the first conductors 3 and the second conductors 4 are previously formed.

Accordingly, the conductors are the integral metal pins with no connecting portion between the first conductors 3 and the second conductors 4. Therefore, no resistance value caused by the connecting portion is generated.

As a result, specific resistances of the conductors are lowered and variations thereof are reduced. In addition, heat generation at the time of energization is reduced, thereby improving reliability of the inductor array 10.

Embodiment of Multilayered Substrate

The configuration of a multilayered substrate 20 according to an embodiment of the present disclosure will be described with reference to FIG. 39.

Figure 39:
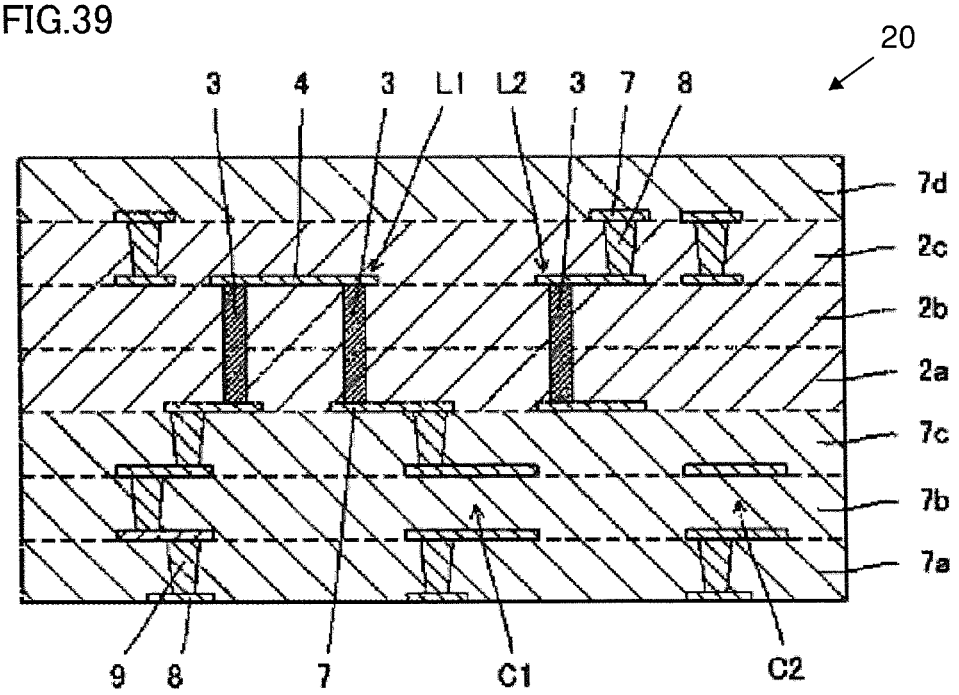
FIG. 39 is a cross-sectional view illustrating a multilayered substrate 20 according to the present disclosure, which corresponds to the cross-sectional view of the plane containing the line Y1-Y1 in FIG. 1 when viewed in the arrow direction.
Figure 40:
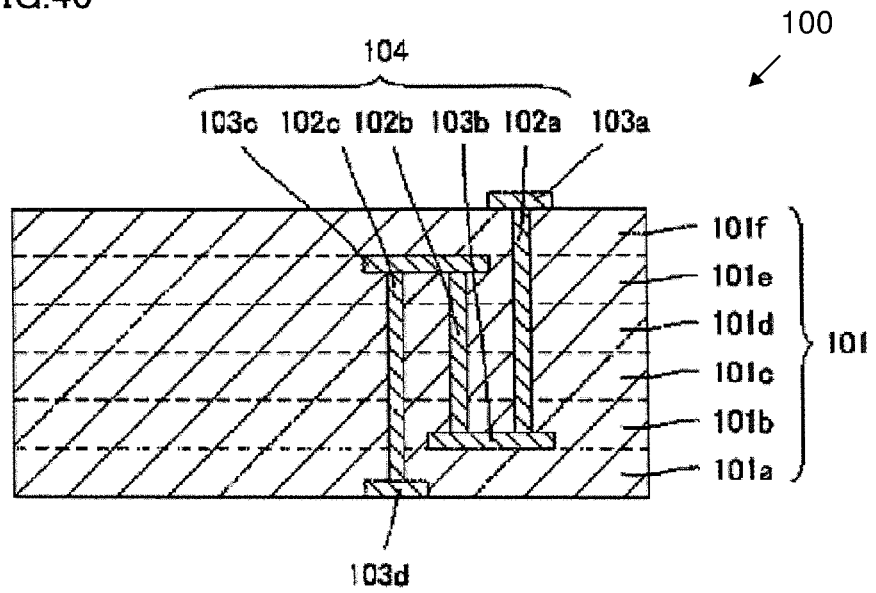
FIG. 40 is a cross-sectional view illustrating a multilayered substrate 100 in the background art.

FIG. 39 is a cross-sectional view illustrating the multilayered substrate 20 in the embodiment of the present disclosure, which corresponds to the cross-sectional view of the plane containing the line Y1-Y1 in FIG. 1 illustrating the inductor device 1 in the first embodiment of the present disclosure when viewed in the arrow direction.

The multilayered substrate 20 includes the first conductors 3 as metal pins, the second conductors 4, the magnetic layers 2*a* to 2*c*, dielectric layers 7*a* to 7*d*, wiring patterns 8 formed on the dielectric layers 7*a* to 7*d*, and via conductors 9 provided in the dielectric layers 7*a* to 7*d*.

The first conductors 3, the second conductors 4, and the magnetic layers 2*a* to 2*c* configure inductors L1 and L2 corresponding to the inductor devices 1 in the first embodiment of the present disclosure. Furthermore, the wiring patterns 8 and the dielectric layer 7*b* configure capacitors C1 and C2.

The multilayered substrate 20 illustrated in FIG. 39 can be manufactured by burying the conductors including the first conductors 3 and the second conductors 4 in the magnetic layers 2*a* to 2*c* by incorporating the method for manufacturing the inductor device 1 in the first embodiment of the present disclosure into a manufacturing process of the multilayered substrate 20.

In the embodiment, in the multilayered substrate 20, each of the magnetic layers 2*a* to 2*c* is formed into a rectangular parallelepiped shape with a top surface as a first main surface and a bottom surface as a second main surface each having a rectangular shape, which oppose each other, and four side surfaces connecting the top surface and the bottom surface. It should be noted that the shape of each of the magnetic layers 2*a* to 2*c* is not limited to the above-described rectangular parallelepiped shape. It is sufficient that the shape is a flat plate shape with a top surface and a bottom surface each having a predetermined shape, which oppose each other, and the arbitrary number of side surfaces each having an arbitrary shape, which connect the top surface and the bottom surface.

The metal pins as the first conductors 3 are alternatives of through-hole conductors or via conductors provided so as to be perpendicular to the top surface and the bottom surface of the magnetic layer in the existing multilayered substrate. It should be noted that the end surfaces of one end portions of the first conductors 3 may be exposed to the bottom surface of the magnetic body 2 so as to function as outer electrodes of the multilayered substrate 20.

In the above-described multilayered substrate 20, the first conductors 3 are not required to be formed by application of plating films to inner side surfaces of through-holes, filling of the through-holes with conductive pastes, or via-fill plating unlike the existing multilayered substrate.

Therefore, the first conductors 3 can be formed with high accuracy. Furthermore, the second conductors 4 can be formed efficiently by printing of conductive pastes, for example. Moreover, defects inside the conductor such as an unfilled portion with conductive pastes, a plating unformed portion, and a lamination displaced portion, are not generated in the first conductors 3.

As a result, in the above-described multilayered substrate 20, specific resistances of the conductors are lowered and variations thereof are reduced. In addition, heat generation at the time of energization is reduced, thereby improving reliability of the multilayered substrate 20.

It should be noted that the present disclosure is not limited to the above-described embodiments and various applications and variations can be added within a range of the present disclosure.

1 INDUCTOR DEVICE
2 MAGNETIC BODY
2*a* to 2*c* MAGNETIC LAYER
3 FIRST CONDUCTOR (METAL PIN)
4 SECOND CONDUCTOR
4*a* UNDERLAYER
4*b* PLATED LAYER
5 OUTER ELECTRODE
S1 CROSS-SECTIONAL AREA OF FIRST CONDUCTOR IN MAGNETIC BODY
S2 AREA OF END PORTION OF FIRST CONDUCTOR, WHICH IS EXPOSED TO SECOND MAIN SURFACE
10 INDUCTOR ARRAY
20 MULTILAYERED SUBSTRATE
50 FIRST BASE
60 SECOND BASE

The invention claimed is:

1. An inductor device comprising:
a magnetic body; and
a conductor buried in the magnetic body,
wherein the conductor includes a first conductor and the first conductor is a metal pin,
the magnetic body has a flat plate shape with a first main surface and a second main surface each having a predetermined shape opposed to each other, and side surfaces connecting the first main surface to the second main surface,
the conductor includes a second conductor that is connected to a first end portion of the first conductor,
the first conductor is provided so as to extend perpendicularly to the first main surface and the second main surface of the magnetic body,
the second conductor includes a first portion which is provided so as to extend in parallel with the first main surface and the second main surface of the magnetic body, and
the second conductor includes a second portion which is provided so as to extend in parallel with the first main surface and the second main surface of the magnetic body and perpendicular to the first portion.

2. The inductor device according to claim 1,
wherein a second end portion of the first conductor is exposed from an outer surface of the magnetic body.

3. The inductor device according to claim 2,
wherein the second end portion of the first conductor exposed from the outer surface of the magnetic body is larger than a cross-sectional area of the first conductor inside the magnetic body.

4. The inductor device according to claim 1,
wherein a second end portion of the first conductor is provided on an outer surface of the magnetic body and is connected to an outer electrode having an area larger than a cross-sectional area of the first conductor.

5. The inductor device according to claim 1,
wherein the second conductor includes an underlayer and a plated layer formed on a surface of the underlayer and the first conductor is directly connected to both of the underlayer and the plated layer of the second conductor.

6. The inductor device according to claim 1,
wherein the second conductor is a metal pin.

7. The inductor device according to claim 6,
wherein the conductor is one bent metal pin having the first conductor and the second conductor integrated.

8. The inductor device according to claim 1,
wherein the conductor includes a plurality of first conductors.

9. An inductor array comprising the inductor device according to claim 1 and further comprising:
a plurality of conductors buried in the magnetic body with predetermined array, the plurality of conductors including the conductor of the inductor device,
wherein each of the plurality of conductors includes a first conductor and each first conductor is a metal pin.

10. A multilayered substrate comprising the inductor device according to claim 1 wherein:
the magnetic body comprises a magnetic layer.

11. A method for manufacturing the inductor device according to claim 1, the method comprising:
a first step for temporarily fixing the first end portion of the first conductor onto a first base such that the first conductor is temporarily supported on the first base, wherein the first conductor is a metal pin;
a second step for preparing an uncured product of a magnetic layer as a part of the magnetic body on a second base;
a third step for forming the magnetic layer as the part of the magnetic body by inserting a second end portion of the first conductor into the uncured product of the magnetic layer as the part of the magnetic body, and then, curing the uncured product;
a fourth step for removing the first base from the first end portion of the first conductor;
a fifth step for forming another magnetic layer as another part of the magnetic body on the second base such that the first conductor is buried in the another magnetic layer in a state where the first end portion of the first conductor is exposed;
a sixth step for forming the second conductor on the another magnetic layer as the another part of the magnetic body, the second conductor being connected to the first end portion of the first conductor and having a predetermined pattern;
a seventh step for forming the magnetic body by forming still another magnetic layer as a remaining part of the magnetic body on the another magnetic layer as the another part of the magnetic body such that the second conductor is buried in the still another magnetic layer; and
an eighth step for removing the second base from the magnetic body and exposing the another second end portion of the first conductor to an outer surface of the magnetic body.

12. A method for manufacturing the inductor device according to claim 1, wherein the second conductor includes an underlayer and a plated layer, the method comprising:
a first step for temporarily fixing a second end portion of the first conductor onto a base such that the first conductor is temporarily supported on the base, wherein the first conductor is a metal pin;
a second step for forming a magnetic layer as a part of the magnetic body on the base such that the first conductor is buried in the magnetic layer in a state where the first end portion of the first conductor is exposed;

a third step for forming the underlayer connected to the first end portion of the first conductor and having a predetermined pattern on the magnetic layer as the part of the magnetic body;

a fourth step for removing the base from the magnetic layer as the part of the magnetic body and exposing the second end portion of the first conductor from an outer surface of the magnetic layer as the part of the magnetic body;

a fifth step for forming the second conductor having a predetermined pattern by growing the plated layer onto an exposed surface of the underlayer while the underlayer serves as a base member; and a sixth step for forming the magnetic body by forming a magnetic layer as a remaining part of the magnetic body on the magnetic layer as the part of the magnetic body such that the second conductor is buried in the magnetic layer as the remaining part of the magnetic body.

13. The method for manufacturing an inductor device according to claim 12, wherein the base includes a first base and a second base, and in the first step the base is the first base and in the fourth step the base being removed is the second base, the method further comprising:

after the first step, preparing an uncured product of a magnetic layer as a part of the magnetic body on a second base;

in the second step, inserting the first end portion of the first conductor into the uncured product of the magnetic layer as the part of the magnetic body until the first end portion of the first conductor abuts against the second base, and then, curing the uncured product; and after the second step, removing the first base from second end portion of the first conductor.

14. The inductor device according to claim 2, wherein the conductor includes a plurality of first conductors.

15. The inductor device according to claim 1, wherein the second conductor has a plate shape.

16. The inductor device according to claim 1, wherein the first portion and second portion of the second conductor each have a linear shape.

17. The inductor device according to claim 1, wherein the second portion of second conductor is bent from the first portion of the second conductor.

18. An inductor device comprising:

a magnetic body; and a conductor buried in the magnetic body, wherein the conductor includes a first conductor and the first conductor is a metal pin, the magnetic body has a flat plate shape with a first main surface and a second main surface each having a predetermined shape opposed to each other, and side surfaces connecting the first main surface to the second main surface, the conductor includes a second conductor that is connected to an end portion of the first conductor, the first conductor is provided so as to extend perpendicularly to the first main surface and the second main surface of the magnetic body, the second conductor is provided so as to extend in parallel with the first main surface and the second main surface of the magnetic body, and the second conductor includes an underlayer and a plated layer formed on a surface of the underlayer and the first conductor is directly connected to both of the underlayer and the plated layer of the second conductor.

* * * * *